US011136797B2

(12) United States Patent
Derham

(10) Patent No.: US 11,136,797 B2
(45) Date of Patent: Oct. 5, 2021

(54) SASH WINDOW RESTRICTOR

(71) Applicant: MIGHTON PRODUCTS LIMITED, Essex (GB)

(72) Inventor: Michael Derham, Cambridge (GB)

(73) Assignee: Mighton Products Limited, Essex (GB)

( * ) Notice: Subject to any disclaimer, the term of this patent is extended or adjusted under 35 U.S.C. 154(b) by 0 days.

(21) Appl. No.: 15/691,010

(22) Filed: Aug. 30, 2017

(65) Prior Publication Data

US 2017/0362862 A1 Dec. 21, 2017

Related U.S. Application Data

(60) Continuation of application No. 14/499,858, filed on Sep. 29, 2014, now Pat. No. 9,816,300, which is a (Continued)

(30) Foreign Application Priority Data

Jun. 19, 2008 (GB) ..... 0811324
Sep. 18, 2008 (GB) ..... 0817136
Sep. 18, 2008 (GB) ..... 0817137

(51) Int. Cl.
*E05B 55/00* (2006.01)
*E05C 3/12* (2006.01)
(Continued)

(52) U.S. Cl.
CPC ..... *E05C 3/12* (2013.01); *E05B 43/00* (2013.01); *E05B 65/0852* (2013.01);
(Continued)

(58) Field of Classification Search
CPC .... E05C 19/003; E05C 19/004; E05C 19/005; E05C 19/007; E05C 19/16; E05C 19/165;
(Continued)

(56) References Cited

U.S. PATENT DOCUMENTS 226,033 A 3/1880 Burns, Jr.
417,868 A 12/1889 Janes
(Continued)

FOREIGN PATENT DOCUMENTS

GB 2 286 627 8/1995
GB 2 410 058 7/2005
(Continued)

OTHER PUBLICATIONS

U.S. Court of Appeals for the Federal Circuit, Appeal No. 2018-1034, Judgment—*Mighton Products Limited* v. *Vision Industries Group, Inc.* , Aug. 7, 2018, 5 pages.
(Continued)

*Primary Examiner* — Jerry E Redman
(74) *Attorney, Agent, or Firm* — Burr & Brown, PLLC

(57) ABSTRACT

A sash window restrictor (20) has a housing (22) which is to be let into a vertical frame member (10) of one sash (normally the upper, outer sash) of a window, at a position, say, 10 cm above the top rail of the lower sash when the windows are closed. A tab (24) is mounted in the housing and can be retracted into the housing or extended from the housing. A mechanism acts between the tab and the housing and allows the tab to be pressed into the housing and held in the housing for a period of time before the tab is released to allow the tab to extend. With the tab extended, the lower sash (12) can be lifted until it reaches the tab (24) but no further, so that a 10 cm gap will be opened at the bottom of the window.

66 Claims, 23 Drawing Sheets

Related U.S. Application Data division of application No. 12/999,751, filed as application No. PCT/GB2009/001526 on Jun. 19, 2009, now Pat. No. 8,881,461.

(51) Int. Cl.

| | |
|---|---|
| ***E05B 43/00*** | (2006.01) |
| ***E05B 65/08*** | (2006.01) |
| ***E05C 1/10*** | (2006.01) |
| ***E05C 7/00*** | (2006.01) |
| *E05B 15/00* | (2006.01) |
| *E05B 17/00* | (2006.01) |
| *E05C 19/02* | (2006.01) |
| *E05C 19/06* | (2006.01) |

(52) U.S. Cl.

CPC ..... *E05B 65/0864* (2013.01); *E05C 1/10* (2013.01); *E05C 7/005* (2013.01); *E05B 15/0046* (2013.01); *E05B 15/0093* (2013.01); *E05B 17/0041* (2013.01); *E05C 19/022* (2013.01); *E05C 19/06* (2013.01); *E05C 2007/007* (2013.01); *Y10T 292/08* (2015.04); *Y10T 292/096* (2015.04); *Y10T 292/1014* (2015.04); *Y10T 292/1043* (2015.04); *Y10T 292/1052* (2015.04); *Y10T 292/1075* (2015.04); *Y10T 292/65* (2015.04)

(58) Field of Classification Search

CPC ..... E05C 17/46; E05C 17/50; E05C 17/54; E05C 17/56; E05C 17/60; E05B 65/0888; E05F 2700/04

USPC ..... 292/195, 219, 220, 228, 202, 203, 204, 292/210, 251.5, 338, 339, 342, 343, 292/DIG. 15, DIG. 20, DIG. 47; 49/449

See application file for complete search history.

(56) References Cited

U.S. PATENT DOCUMENTS

| | | | |
|---|---|---|---|
| 719,981 | A | 2/1903 | Adams |
| 756,453 | A | 4/1904 | Arens et al. |
| 764,493 | A | 7/1904 | Noseworthy |
| 785,367 | A | 3/1905 | Mason |
| 833,900 | A | 10/1906 | Sigler |
| 881,658 | A | 3/1908 | Bowman |
| 976,777 | A | 11/1910 | Brown |
| 1,261,274 | A | 4/1918 | Newsam |
| 1,601,051 | A | 9/1926 | Wilbert |
| 1,724,637 | A | 8/1929 | Bergstrom |
| 2,503,370 | A | 4/1950 | Zanona |
| 4,824,154 | A | 4/1989 | Simpson |
| 4,917,416 | A | 4/1990 | Westphal et al. |
| 4,919,464 | A | 4/1990 | Richards |
| 5,188,405 | A | 2/1993 | Maccaferri |
| 5,248,174 | A | 9/1993 | Matz et al. |
| 5,307,655 | A | 5/1994 | Boltz et al. |
| 5,536,052 | A | 7/1996 | Maier |
| 5,553,903 | A | 9/1996 | Prete et al. |
| 5,575,116 | A | 11/1996 | Carlson et al. |
| 5,806,900 | A | 9/1998 | Bratcher et al. |
| 6,000,735 | A | 12/1999 | Jourdenais |
| D420,375 | S | 2/2000 | Goff et al. |
| 6,021,603 | A | 2/2000 | Prete et al. |
| D430,887 | S | 9/2000 | Goff et al. |
| 6,356,400 | B1 | 3/2002 | Goff et al. |
| 6,364,375 | B1 | 4/2002 | Szapucki et al. |
| 6,417,894 | B1 | 7/2002 | Goff et al. |
| 6,418,578 | B1 | 7/2002 | Polevoy et al. |
| 6,568,031 | B1 | 5/2003 | Polevoy et al. |
| 6,575,503 | B1 | 6/2003 | Johansson et al. |
| 6,625,827 | B1 | 9/2003 | Polevoy et al. |
| 6,685,379 | B2 | 2/2004 | Polevoy et al. |
| 6,764,176 | B1 | 7/2004 | Carlson et al. |
| 6,826,790 | B1 | 12/2004 | Polevoy et al. |
| 6,848,728 | B2 | 2/2005 | Rotondi et al. |
| 6,851,140 | B2 | 2/2005 | Polevoy et al. |
| 6,854,160 | B2 | 2/2005 | Polevoy et al. |
| 6,854,214 | B2 | 2/2005 | Polowinczak |
| 7,007,321 | B2 | 3/2006 | Polevoy et al. |
| 7,073,218 | B2 | 7/2006 | Polevoy et al. |
| 7,100,228 | B2 | 9/2006 | Polevoy et al. |
| 7,147,255 | B2 | 12/2006 | Goldenberg et al. |
| 7,188,871 | B2 | 3/2007 | Nemoto et al. |
| 7,219,378 | B2 | 5/2007 | Polevoy et al. |
| 7,296,831 | B2 | 11/2007 | Generowicz et al. |
| 7,363,664 | B2 | 4/2008 | Polevoy et al. |
| 7,363,665 | B2 | 4/2008 | Polevoy et al. |
| 7,363,666 | B2 | 4/2008 | Polevoy et al. |
| 7,396,054 | B2 | 7/2008 | Carrier |
| 7,407,199 | B2 | 8/2008 | Richardson |
| 7,431,356 | B2 | 10/2008 | Liang et al. |
| 7,441,811 | B2 | 10/2008 | Lawrence |
| 7,452,014 | B2 | 11/2008 | Vetter |
| 7,494,164 | B1 | 2/2009 | Garries et al. |
| 7,530,611 | B2 | 5/2009 | Liang et al. |
| 7,588,271 | B1 | 9/2009 | Lawrence |
| 7,591,494 | B2 | 9/2009 | Mitchell |
| 7,600,796 | B2 | 10/2009 | Liang et al. |
| 7,610,682 | B2 | 11/2009 | Polevoy et al. |
| 7,637,544 | B2 | 12/2009 | Liang et al. |
| 7,644,456 | B2 | 1/2010 | Polevoy et al. |
| 7,665,163 | B2 | 2/2010 | Polevoy et al. |
| 7,694,363 | B2 | 4/2010 | Polevoy et al. |
| 7,874,027 | B2 | 1/2011 | Polevoy et al. |
| 7,954,184 | B2 | 6/2011 | Polevoy et al. |
| 8,006,328 | B2 | 8/2011 | Polevoy et al. |
| 8,021,282 | B2 | 9/2011 | Polevoy et al. |
| 8,360,484 | B2 | 1/2013 | Liang et al. |
| 8,662,347 | B2 | 3/2014 | Coggins et al. |
| 8,776,440 | B2 | 7/2014 | Sopkowiak et al. |
| 8,776,442 | B1 | 7/2014 | Lawrence |
| 8,789,221 | B2 | 7/2014 | Polevoy et al. |
| 8,806,809 | B1 | 8/2014 | Lawrence |
| 8,832,881 | B2 | 9/2014 | Polevoy et al. |
| 8,881,461 | B2 | 11/2014 | Derham |
| 9,216,851 | B2 | 12/2015 | Coggins et al. |
| 9,247,825 | B2 | 2/2016 | Polevoy et al. |
| 2003/0167694 | A1 | 9/2003 | Liang |
| 2005/0156433 | A1 | 7/2005 | Nemoto et al. |
| 2006/0033345 | A1 | 2/2006 | Richardson |
| 2007/0194578 | A1 | 8/2007 | Boosey et al. |
| 2007/0209285 | A1 | 9/2007 | Bestler et al. |
| 2007/0222233 | A1 | 9/2007 | Liang et al. |
| 2007/0222234 | A1 | 9/2007 | Liang et al. |
| 2008/0079268 | A1 | 4/2008 | Liang et al. |
| 2008/0127568 | A1 | 6/2008 | Liang et al. |
| 2009/0206616 | A1 | 8/2009 | Liang et al. |
| 2010/0281780 | A1 | 11/2010 | Liang et al. |
| 2010/0300000 | A1 | 12/2010 | Liang et al. |
| 2011/0113695 | A1 | 5/2011 | Derham |
| 2012/0144752 | A1 | 6/2012 | Piltingsrud |
| 2012/0291359 | A1 | 11/2012 | Hans et al. |
| 2015/0113880 | A1 | 4/2015 | Piltingsrud |

FOREIGN PATENT DOCUMENTS

| | | |
|---|---|---|
| JP | 5171848 | 7/1993 |
| WO | 91/18168 | 11/1991 |
| WO | 99/46464 | 9/1999 |
| WO | 2004/038141 | 5/2004 |
| WO | 2005/078218 | 8/2005 |
| WO | 2009/072839 | 6/2009 |

OTHER PUBLICATIONS

International Search Report and the Written Opinion of the International Searching Authority dated Sep. 29, 2009, 18 pages.

Michael D. Fischer, Window & Door, *Continued Progress in Window Safety*, Aug. 2, 2009, 2 pages.

(56) References Cited

OTHER PUBLICATIONS

Case No. IPR 2016-00792, U.S. Pat. No. 8,881,461, Petition for Inter Partes Review, *Vision Industries Group, Inc.* v. *Mighton Products Limited*, Mar. 8, 2016, 56 pages.
Case No. IPR 2016-00792, U.S. Pat. No. 8,881,461, Declaration of Luke Liang, *Vision Industries Group, Inc.* v. *Mighton, Inc.*, Mar. 8, 2016, 5 pages.
Case No. IPR 2016-00792, U.S. Pat. No. 8,881,461, Declaration of Paul Carlson, *Vision Industries Group, Inc.* v. *Mighton, Inc.*, Mar. 8, 2016, 58 pages.
Case No. IPR 2016-00792, U.S. Pat. No. 8,881,461, Patent Owner Preliminary Response, *Vision Industries Group, Inc.* v. *Mighton, Inc.*, Jun. 29, 2016, 66 pages.
Case No. IPR 2016-00792, U.S. Pat. No. 8,881,461, Decision, Institution of Inter Partes Review, *Vision Industries Group, Inc.* v. *Mighton, Inc.*, Sep. 22, 2016, 31 pages.
Case No. IPR 2016-00792, U.S. Pat. No. 8,881,461, Patent Owner's Contingent Motion to Amend Claims, *Vision Industries Group, Inc.* v. *Mighton, Inc.*, Dec. 22, 2016, 38 pages.
Case No. IPR 2016-00792, U.S. Pat. No. 8,881,461, Declaration of Michael John Hawker, *Vision Industries Group, Inc.* v. *Mighton, Inc.*, Dec. 22, 2016, 71 pages.
Case No. IPR 2016-00792, U.S. Pat. No. 8,881,461, Patent Owner's Response to Petition, *Vision Industries Group, Inc.* v. *Mighton, Inc.*, Dec. 22, 2016, 56 pages.
Case No. IPR 2016-00792, U.S. Pat. No. 8,881,461, Petitioner's Opposition to Patent Owner's Motion to Substitute Claims, *Vision Industries Group, Inc.* v. *Mighton, Inc.*, Mar. 20, 2017, 29 pages.
Case No. IPR 2016-00792, U.S. Pat. No. 8,881,461, Petitioner's Reply to Patent Owner Response, *Vision Industries Group, Inc.* v. *Mighton, Inc.*, Mar. 20, 2017, 22 pages.
Case No. IPR 2016-00792, U.S. Pat. No. 8,881,461, Declaration of Paul Carlson in Support of Petitioner's Reply and in Opposition to Patent Owner's Motion to Substitute Claims, *Vision Industries Group, Inc.* v. *Mighton, Inc.*, Mar. 20, 2017, 39 pages.
Case No. IPR 2016-00792, U.S. Pat. No. 8,881,461, Petitioner's Exhibit 1016, *Vision Industries Group, Inc.* v. *Mighton, Inc.*, Mar. 20, 2017, 7 pages.
Case No. IPR 2016-00792, U.S. Pat. No. 8,881,461, Third Updated Exhibit List, *Vision Industries Group, Inc.* v. *Mighton, Inc.*, Mar. 20, 2017, 3 pages.
Case No. IPR 2016-00792, U.S. Pat. No. 8,881,461, Patent Owner's Reply to Petitioner's Opposition to Motion to Amend Pursuant to 37 C.F.R. § 42.121, *Vision Industries Group, Inc.* v. *Mighton, Inc.*, Apr. 24, 2017, 16 pages.
Case No. IPR 2016-00792, U.S. Pat. No. 8,881,461, Request for Oral Argument, *Vision Industries Group, Inc.* v. *Mighton, Inc.*, May 11, 2017, 4 pages.
Case No. IPR 2016-00792, U.S. Pat. No. 8,881,461, Patent Owner Mighton Products Limited's Request for Oral Argument Pursuant to 37 C.F.R. §42.70, *Vision Industries Group, Inc.* v. *Mighton, Inc.*, May 12, 2017, 4 pages.
Case No. IPR 2016-00792, U.S. Pat. No. 8,881,461, Order Trial Hearing, Before Josiah C. Cocks, Hyun J. Jung and Robert L. Kinder, Administrative Patent Judges, *Vision Industries Group, Inc.* v. *Mighton, Inc.*, May 18, 2017, 5 pages.
Case No. IPR 2016-00792, U.S. Pat. No. 8,881,461, Patent Owner Mighton Products Limited's Demonstrative Exhibits for Oral Argument, *Vision Industries Group, Inc.* v. *Mighton, Inc.*, Jun. 8, 2017, 9 pages.
Case No. IPR 2016-00792, U.S. Pat. No. 8,881,461, Petitioner's Demonstratives, *Vision Industries Group, Inc.* v. *Mighton, Inc.*, Jun. 8, 2017, 19 pages.
Case No. IPR 2016-00792, U.S. Pat. No. 8,881,461, Record of Oral Hearing, *Vision Industries Group, Inc.* v. *Mighton, Inc.*, Jun. 13, 2017, 76 pages.
Case No. IPR 2016-00792, U.S. Pat. No. 8,881,461, Transcript of Hearing—Condensed, *Vision Industries Group, Inc.* v. *Mighton, Inc.*, Jun. 13, 2017, 42 pages.
Case No. IPR 2016-00792, U.S. Pat. No. 8,881,461, Transcript of Hearing—Full, *Vision Industries Group, Inc.* v. *Mighton, Inc.*, Jun. 13, 2017, 93 pages.
Court of Appeals for the Federal Circuit, Appeal No. 2018-1034, Corrected Opening Brief of Appellant Mighton Products Limited—*Mighton Products Limited* v. *Vision Industries Group, Inc.* , Jan. 22, 2018, 158 pages.
Case No. IPR 2016-00792, U.S. Pat. No. 8,881,461, Final Written Decision—Order Denying Motion to Amend—*Vision Industries Group, Inc.* v. *Mighton Products Limited*, Sep. 20, 2017, 52 pages.
U.S. Court of Appeals for the Federal Circuit, Appeal No. 2018-1034, Brief for Appellee—*Mighton Products Limited* v. *Vision Industries Group, Inc.* , Feb. 28, 2018, 59 pages.
U.S. Court of Appeals for the Federal Circuit, Appeal No. 2018-1034, Reply Brief of Appellant—*Mighton Products Limited* v. *Vision Industries Group, Inc.* , Mar. 14, 2018, 23 pages.
U.S. Court of Appeals for the Federal Circuit, Appeal No. 2018-1034, Joint Appendix—*Mighton Products Limited* v. *Vision Industries Group, Inc.* , Mar. 21, 2018, 359 pages.
U.S. Court of Appeals for the Federal Circuit, Appeal No. 2018-1034, Joint Statement of Compliance With Federal Circuit Rule 17(f)—*Mighton Products Limited* v. *Vision Industries Group, Inc.* , Mar. 21, 2018, 3 pages.
U.S. Court of Appeals for the Federal Circuit, Appeal No. 2018-1034, Joint Statement of Compliance With Federal Circuit Rule 33(a)—*Mighton Products Limited* v. *Vision Industries Group, Inc.* , Mar. 21, 2018, 3 pages.
U.S. Court of Appeals for the Federal Circuit, Appeal No. 2018-1034, Appellant's Notice Regarding Conflicts With Argument Dates Pursuant to Practice Note 34—*Mighton Products Limited* v. *Vision Industries Group, Inc.* , Apr. 3, 2018, 3 pages.
U.S. Court of Appeals for the Federal Circuit, Appeal No. 2018-1034, Appellee's Notice Regarding Conflicts With Argument Dates Pursuant to Practice Note 34—*Mighton Products Limited* v. *Vision Industries Group, Inc.* , Apr. 3, 2018, 3 pages.
U.S. Court of Appeals for the Federal Circuit, Appeal No. 2018-1034, Appellant's Second Notice Regarding Conflicts With Argument Dates Pursuant to Practice Note 34—*Mighton Products Limited* v. *Vision Industries Group, Inc.* , Jun. 6, 2018, 3 pages.

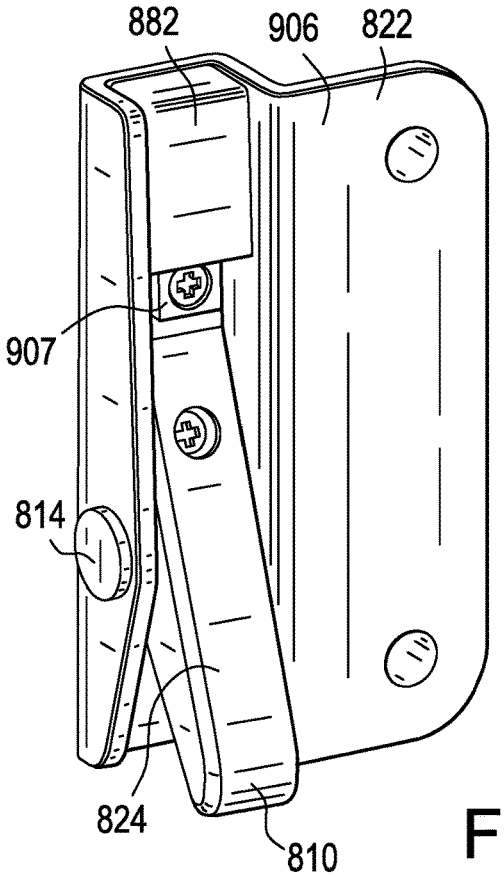
FIG. 39
FIG. 40
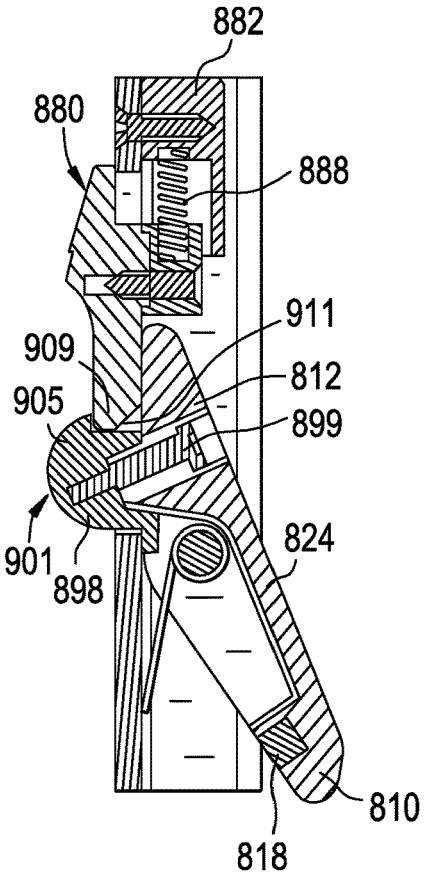
FIG. 41
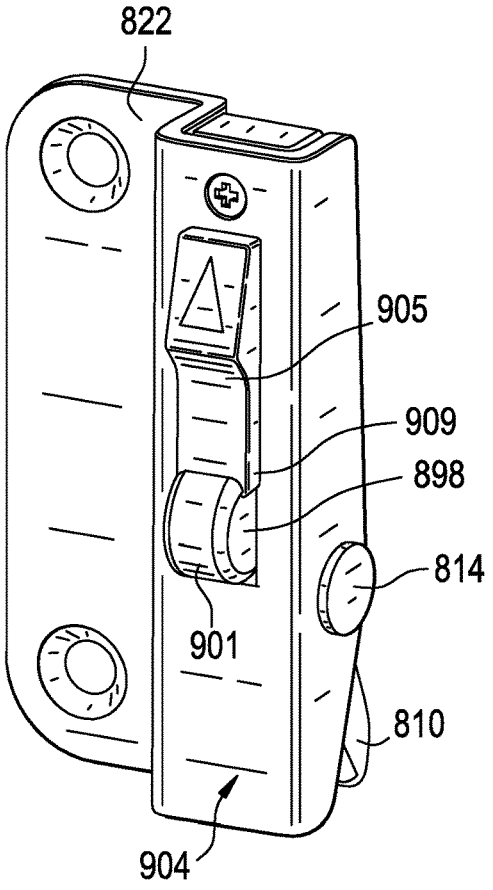

SASH WINDOW RESTRICTOR

CROSS-REFERENCE TO RELATED APPLICATIONS

This application is a continuation of U.S. patent application Ser. No. 14/499,858, filed Sep. 29, 2014 (now U.S. Pat. No. 9,816,300), which is a division of U.S. patent application Ser. No. 12/999,751, filed Dec. 17, 2010 (granted as U.S. Pat. No. 8,881,461), the entireties of which are incorporated herein by reference.

FIELD OF THE INVENTION

This invention relates to a device for limiting or restricting the extent of opening of a sliding sash window. This device will be referred to herein as a sash window restrictor.

There is a requirement to restrict the extent to which a sash window can be opened, partly to prevent children opening a window beyond a certain distance so that they cannot fall out through the window, and partly from an anti-theft point of view, to prevent the window being opened from the outside.

However any such restrictor needs to be capable of being overridden when the window is to be fully opened by an adult, from the inside.

It is an aim of the present invention to overcome at least one problem associated with the prior art whether referred to herein or otherwise.

SUMMARY OF THE INVENTION

According to a first aspect of the present invention, there is provided a sash restrictor comprising a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

Preferably the latching means requires an actuation in order to release the tab and to allow the tab to extend from the housing.

The latching means may comprise magnetic means. Preferably the tab comprises a first magnetic member and the housing comprises a second magnetic member and wherein, in the latched condition, the first magnetic member engages with the second magnetic member.

In order to change from a latched condition to an unlatched condition, preferably the first magnetic member is relatively moved to a position sufficiently spaced from the second magnetic member. Preferably the first magnetic member is arranged, in use, to be moved relative to the second magnetic member manually by a user.

The mechanism may comprise urging means to urge first magnetic member away from the second magnetic member.

The mechanism may comprise urging means to urge the tab from the retracted position to the extended position. Preferably the urging means resists movement of the tab from the extended position to the retracted position.

The urging means may comprise resilient means.

The urging means may comprise a spring and preferably comprises a torsion spring.

Preferably the tab is pivotally mounted to the housing.

Preferably the tab comprises a first arm and a second arm. The first arm may comprise a latching member and the second arm may comprise an actuation member in order to unlatch the tab from a retracted position. The first arm may comprise an actuation member in order to latch the tab in a retracted position.

Preferably, in use, a user manually moves the tab to a latched position to enable a sash to move relatively over the housing and the tab may then be unlatched either manually by the user or by the action of the sash in order to enable urging means to move the tab from the retracted position towards an extended position.

Preferably the tab is moveable to a first position in which the tab is at least partially (and more preferably totally) retracted into the housing and the tab may not project beyond the housing. Preferably the housing is moveable to a second position in which at least a part of the tab projects outwardly relative to the housing.

Preferably, in use, the tab is arranged to be manually moved from the second position to the first position and preferably for the tab to be latched in the first position.

Preferably, in use, the tab is arranged to automatically move by movement means from the first position to the second position and preferably once the tab has been unlatched by an actuation.

Preferably, in use, the tab is arranged to automatically move by movement means from a first retracted position to a second extended position once the tab has been unlatched by an actuation.

The actuation may comprise a manual actuation and may comprise a push movement by a user.

The actuation may comprise a contact force generated by movement of the sash window relative to the sash window restrictor.

The tab may be retained in the housing by magnetic means.

The housing will preferably be set into a vertical frame member of one sash (normally the upper, outer sash) of a window, at a position, say, 10 cm above the top rail of the lower sash when the windows are closed. When the tab is retracted, the tab may lie substantially flush with the frame member, but when extended will project from the frame member sufficiently far to prevent the lower sash from passing. With the tab extended, the lower sash can be lifted until it reaches the tab but no further, so that a 10 cm gap will be opened at the bottom of the window.

When the window is to be opened fully, the tab will be pressed in and the bottom sash will be slid up, past the retracted tab, before the tab is able to extend.

There may be restrictor devices on both sides of the window, or just on one side. If there are restrictor devices on both sides, two separate operations will be required before the window can open, and this can provide an added security measure to make it more difficult for a window to be opened by a child.

Where there is a restrictor device on only one side, the device may have a second user-actuated feature so that the tab can only be pressed in once the second feature has been actuated. Again, this can provide an added security measure to make it more difficult for a window to be opened by a child.

Many different mechanisms can be used to hold the tab in the housing for a period of time. Generally the tab will be extended from the housing by a spring, and when pressed back in, i.e. retracted into the housing, the spring will be tensioned. It may however be possible to design a mechanism where gravity, or another method, is used to extend the tab from the housing The tab may be pivoted in the housing such that one end of the tab will project from the housing, in the extended position. Alternatively, the tab may move linearly into and out of the housing. Part of the edge of the tab which, in use, will be facing the lower sash may have an inclined face to allow the sash to pass the tab, pushing it in to the housing as it does so, to allow the sash to pass even if the tab is not completely retracted. However such inclined face should only be at the outermost part of the tab edge, as the main part of that tab edge should be substantially at right angles to the direction of movement of the lower sash, so as to prevent the sash passing when the tab is fully extended.

The mechanism between the tab and the housing preferably incorporates a spring and energy is stored in the spring when the tab is pushed into the housing. The mechanism may lock the tab in the retracted position, and a trigger may be activated by the passing of the lowers sash to release the lock and to allow the tab to be extended by the spring. While the lower sash lies in front of the device, the tab can only extend into contact with the lower sash frame, but one the lower sash is returned to its closed position, the tab will spring fully out to prevent reopening of the window without the tab being pushed in again.

In another embodiment, the tab can be linearly movable and can be controlled by a push-push mechanism where the first push locks the tab in its retracted position in the housing and a subsequent push releases the tab, allowing it to extend. The second push can be provided by the lower sash as it passes the device.

In one form, the mechanism will not lock the tab in its retracted position, but will damp the restoring force of the spring, so that the spring is only able to slowly extend the tab. However in other embodiments, the tab may lock into the housing and a separate trigger can be operated, for example by movement of the lower sash, to release the tab.

Instead of a lock, the stored spring force may be released only slowly, for example under the control of some form of damping system. In this embodiment, the tab will start to extend as soon as the force pushing it into the retracted position is released. However the speed at which the tab extends will be slow enough to allow the lower sash to be moved past the device before very much extension has taken place.

According to a second aspect of the present invention, there is provided an assembly comprising a sash and a sash restrictor, the sash restrictor comprising a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

Preferably the sash restrictor prevents or at least inhibits movement of the sash relative to the sash restrictor whilst the tab is in the extended position.

Preferably the sash restrictor enables movement of the sash passed the sash restrictor whilst the tab is initially in a retracted position.

According to a third aspect of the present invention, there is provided a kit for assembly into a sash restrictor, the kit comprising a housing, a tab which is retractable, in use, into the housing and extendable from the housing, and a mechanism acting, in use, between the tab and the housing which allows the tab to be pressed into the housing and which holds the tab in the housing, the mechanism comprising latching means to latch the tab in a retracted position.

According to a fourth aspect of the present invention, there is provided a method of restricting movement of a sash comprising mounting a sash restrictor adjacent to a sash wherein the sash restrictor comprises a housing, a tab which is retractable into the housing and extendable from the housing, and a mechanism acting between the tab and the housing which allows the tab to be pressed into the housing and which holds the tab in the housing, the mechanism comprising latching means to latch the tab in a retracted position.

The method may comprise pushing the tab into the housing to latch the tab in a retracted position.

The method may comprise pushing an actuating member to release the latching means.

BRIEF DESCRIPTION OF THE DRAWINGS

The invention will now be further described, by way of example, with reference to the accompanying drawings, in which:

FIG. 39 is a rear perspective view of the sash window restrictor of FIG. 38;

FIG. 40 is a cross-sectional view of the sash window restrictor of FIG. 38;

FIG. 41 is a front perspective view of the sash window restrictor of FIG. 38;

DESCRIPTION OF THE PREFERRED EMBODIMENTS

Figure 1:
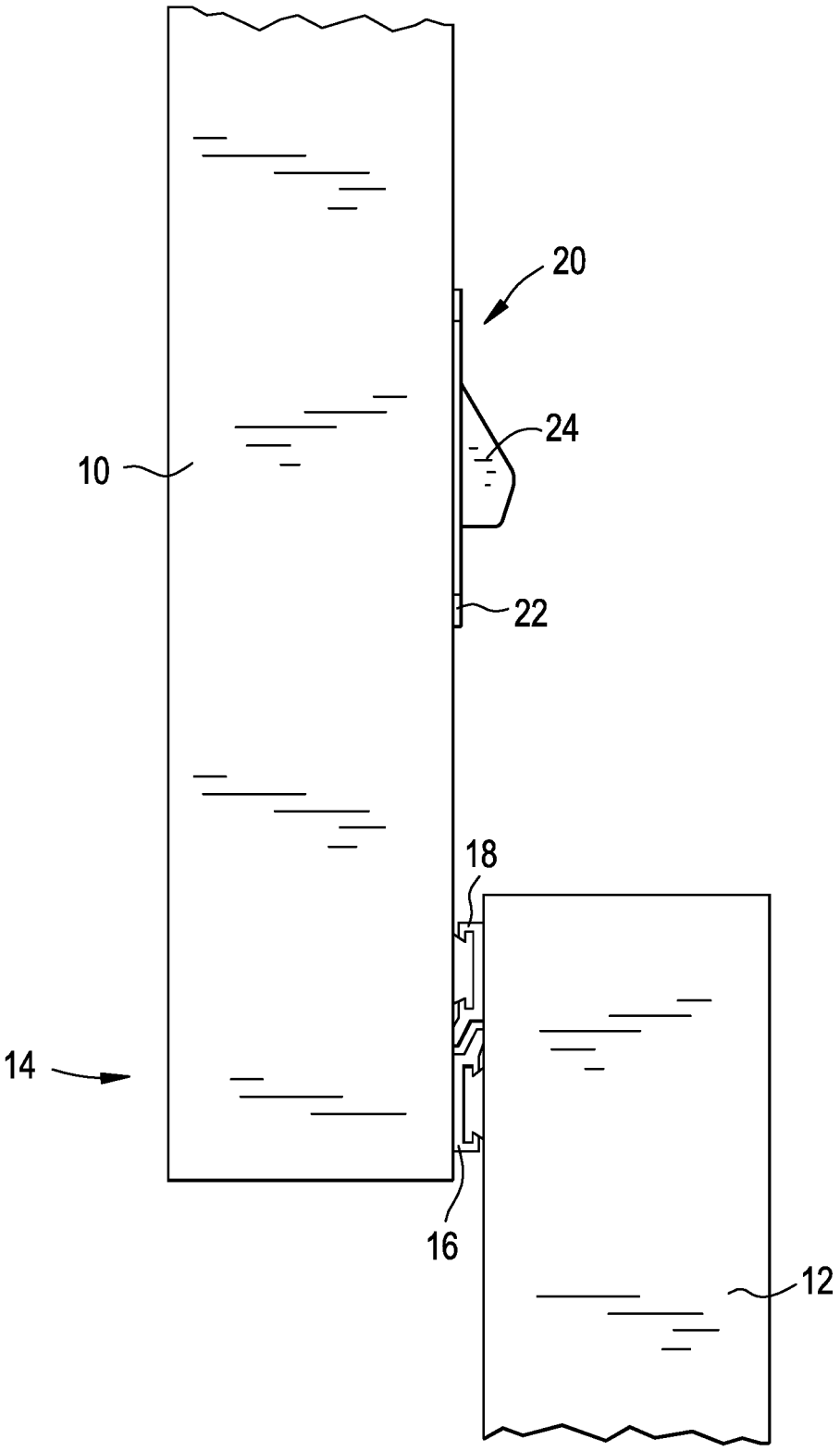
FIG. 1 is a side view through part of an upper and a lower sash, with a sash limiter device in accordance with the invention fitted in the upper sash.

FIG. 1 shows, in side view, an upper sash 10 and a lower sash 12. The sashes are shown in the position which they would take up when the window is closed, and in this position, the horizontal meeting rails of the two sashes overlap at 14. Weather seals 16, 18 are shown on the respective sashes to provide a seal when the window is closed.

The upper sash includes a sash limiter device at 20. This device has a housing 22 which is recessed into the sash frame 10, and a tab 24 which is movable between an extended, projecting position as shown, and a retracted position where it is housed substantially completely in the housing 22.

In the extended position of the tab 24 as shown in FIG. 1, the lower sash 12 can be raised relative to the upper sash 10, until the upper face of the lower sash comes into contact with the tab 24. Further lifting of the lower sash 12 is then prevented. However when it is desired to open the window completely, and to raise the lower sash 12 past the limiter device 20, the tab 24 can be pressed back and retracted into the housing 22 to allow the lower sash to pass the device.

It is desirable that the retracted tab should automatically extend itself out of the housing 20, once the leading edge of the lower sash 12 has moved passed. Thus, once the leading edge of the lower sash 12 has passed the device, the tab will extend, either gradually or quickly, and as the lower sash is lifted further, the tab will bear against a surface of the lower sash frame. In this way, once the lower sash is lowered again and the window is closed, the tab will automatically move to its extended position without any user intervention being required.

The tab will preferably be spring-loaded and can be pressed into the housing against spring pressure, with the spring being released to re-extend the tab once the lower sash has passed the device. In some embodiments, a secondary lock may lock the tab in the open position, and require release before the tab can be pressed in. It may be necessary to hold a button or the like release mechanism whilst at the same time pressing in the tab.

Figure 2:
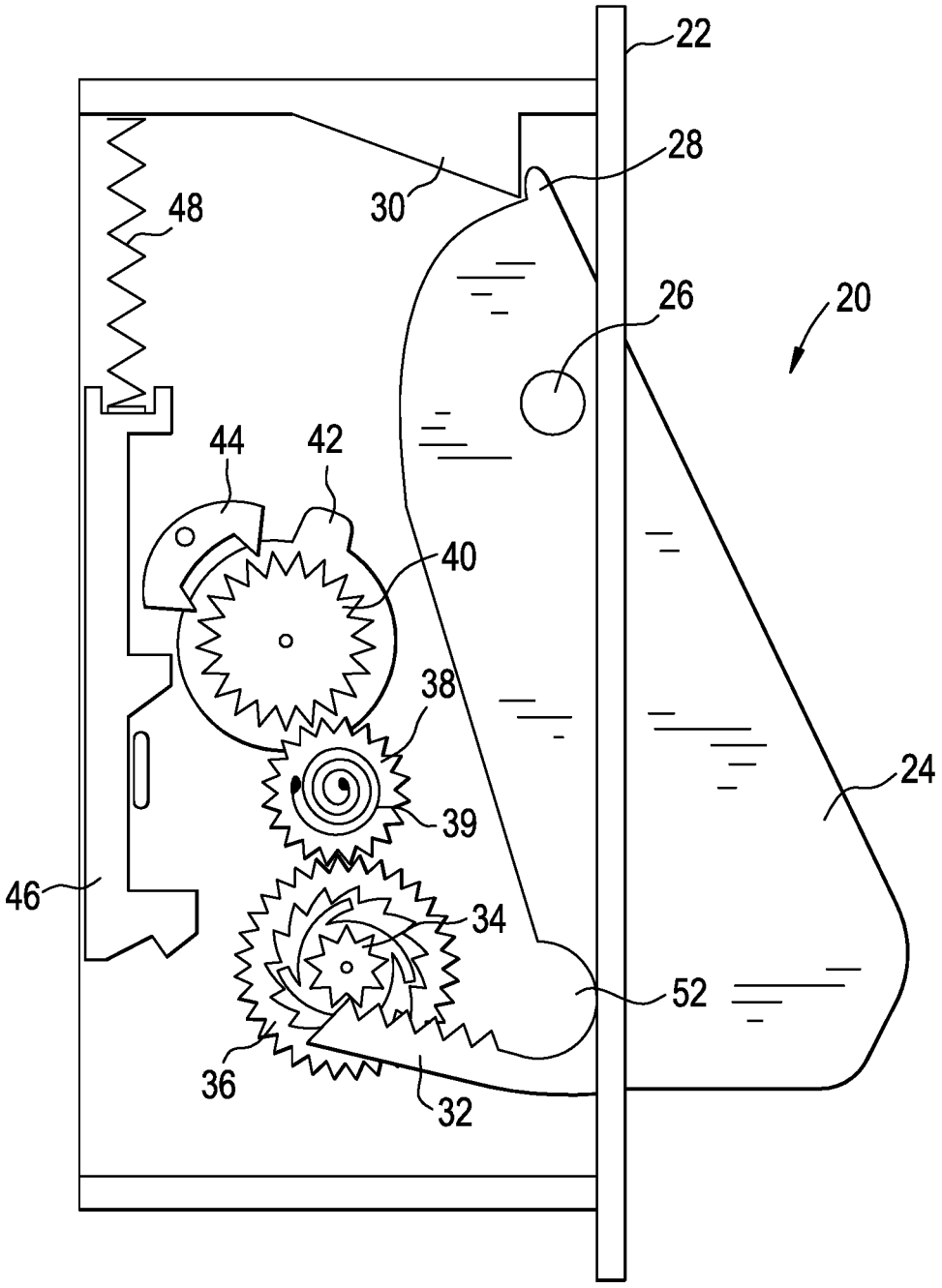
FIG. 2 is a schematic representation of the sash limiter device from FIG. 1, with the tab extended.
Figure 3:
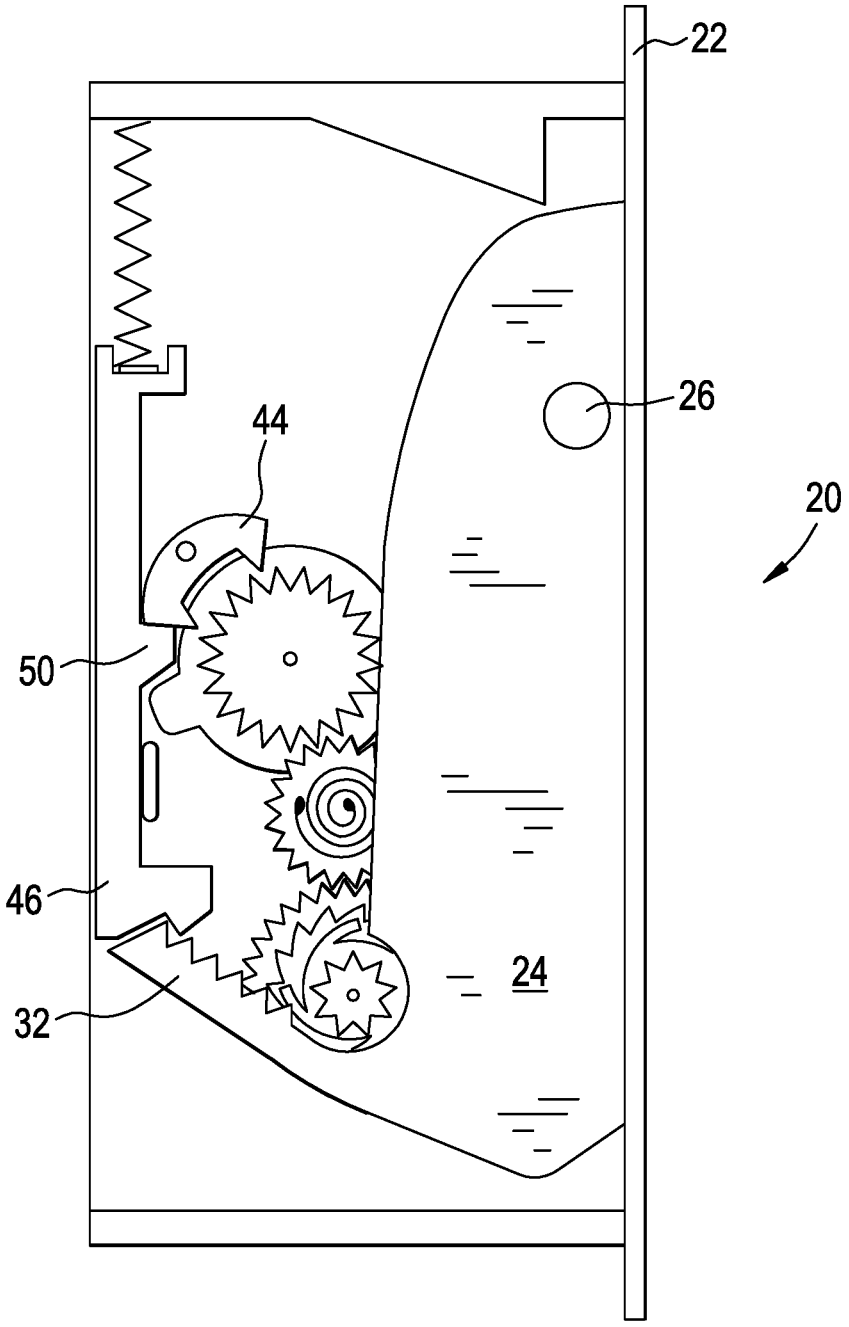
FIG. 3 corresponds to FIG. 2 but shows the tab retracted.

The tab itself may take up a number of different configurations. In FIGS. 1, 2 and 3 the tab is generally triangular and is pivoted at 26 in the housing. The tab may however slide in the housing between its extended and retracted positions. The tab has a tapered edge at 24*a*, so that the lower sash can pass over the tab, even though the tab might not be fully retracted.

FIG. 2 shows one example of a mechanism which can be used to control extension and retraction of the tab 24. The extension of the tab, into the position shown in FIG. 2, is limited by engagement between an ear 28 on the tab and a shoulder 30 in the housing.

When the tab is pushed in, a rack 32 which is integral with the tab engages with a first, inner sprocket 34 and rotates that sprocket in a clockwise direction. This rotation entrains an outer sprocket 36. The outer sprocket 36 engages with a second sprocket 38, and this second sprocket includes a coil spring 39 which is wound up as the tab is pushed in and the second sprocket rotates. A third sprocket 40 meshes with the sprocket 38 and has a release cam 42 at one point around its circumference, and an escapement 44. The housing also contains a retaining plate 46 which is vertically slidable in the housing under the influence of a spring 48.

As can be seen from FIG. 3, when the tab is fully retracted, the end of the rack 32 engages with a detent on the bottom of the plate 46, and in this position the tab 24 is held in the retracted position. However the stored energy in the spring 39 continues to drive the sprocket 40 and its associated cam 42 in a clockwise direction. The extent to which the rotation can take place is limited by the rocking movement of the escapement 44, but the cam 42 will contact a lug 50 on the plate 46, to release the tab which will then be driven into its extended position by the stored energy in the spring 39.

It will be noted that the first sprocket 34 has a clutch mechanism within the outer sprocket 36, and this ensures that rotation of the sprocket 34 in a clockwise direction rotates the outer sprocket 36, but when the inner sprocket rotates in the opposite direction, the sprocket 36 is not entrained. In the retracted position shown in FIG. 3, the inner sprocket 34 can rotate freely within a part circular cut-out 52 in the tab.

Figure 4:
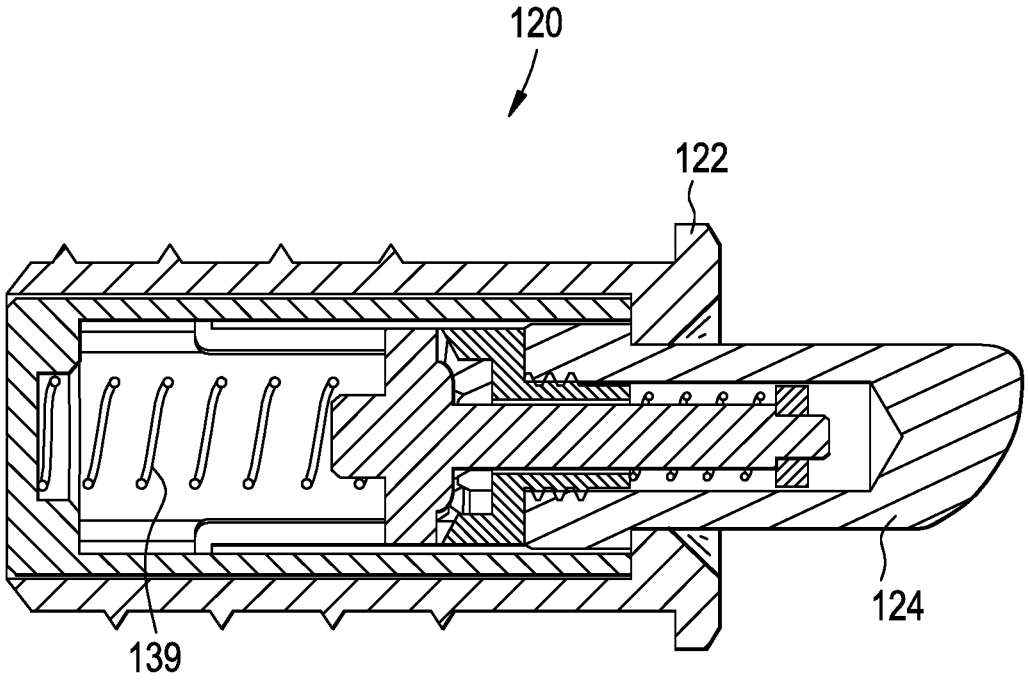
FIG. 4 is a cross-sectional view through a second type of sash limiter device in accordance with the invention.
Figure 5:
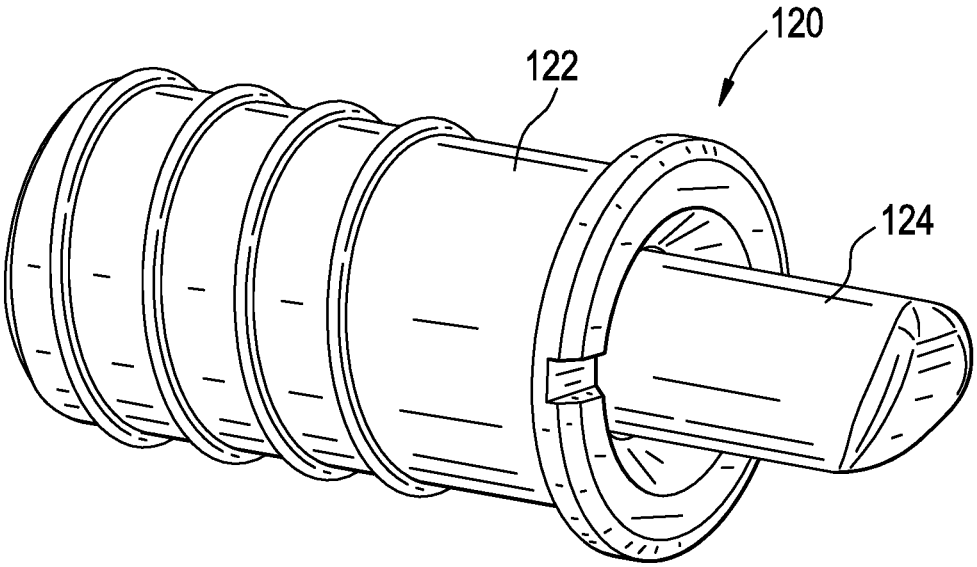
FIG. 5 is a perspective view of the device of FIG. 4.
Figure 6:
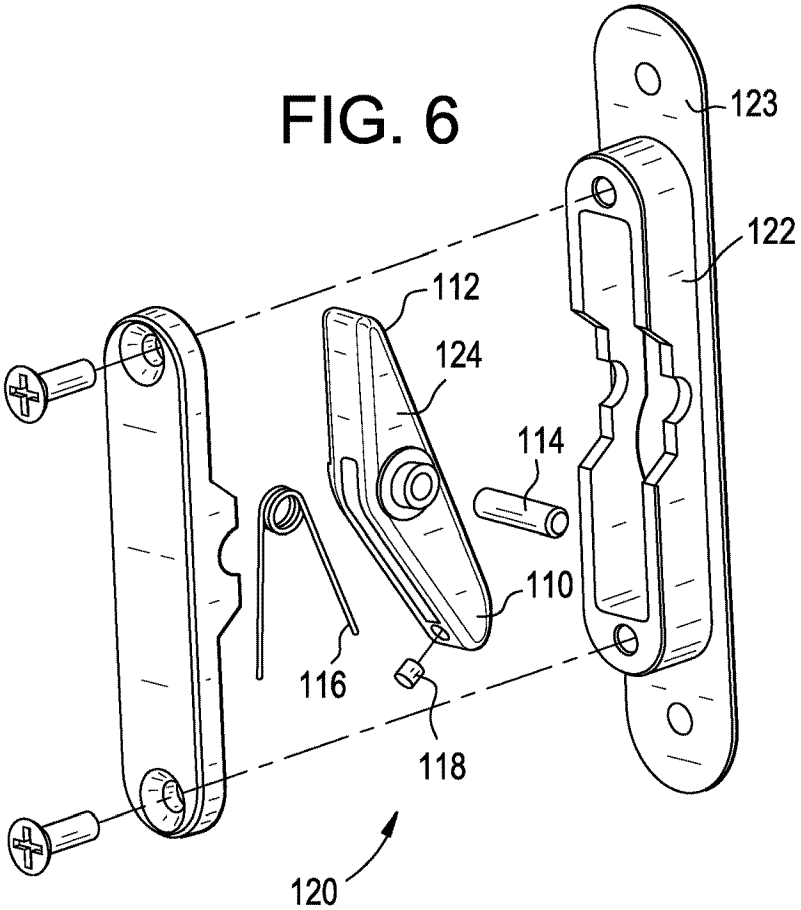
FIG. 6 is an exploded view of a preferred embodiment of a sash window restrictor.
Figure 9:
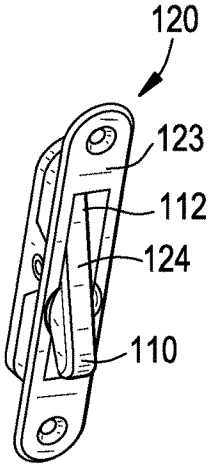
FIG. 9 is a perspective view of a preferred embodiment of a sash window restrictor.
Figure 8:
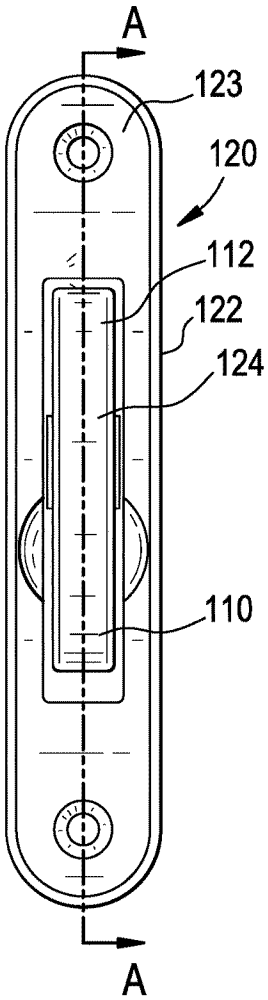
FIG. 8 is a front view of a preferred embodiment of a sash window restrictor.
Figure 7:
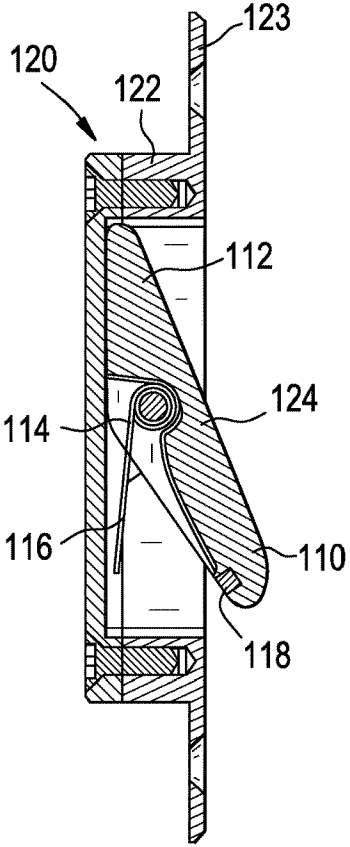
FIG. 7 is a side cross section of a preferred embodiment of a sash window restrictor.

FIGS. 4 and 5 show another embodiment where the tab 124 slides linearly into and out of a housing 122. The mechanism of this device works on a "push-push" principle, i.e. when the tab 124 is pushed in, it locks into a retracted position and if it is pushed again, the lock is released and a spring 139 extends the tab. In this case, the tab 124 has a tapered end, and the dimensions and stroke of the tab 124 will be such that, in the retracted position, the tip of the tab extends from the housing 122, with the tapered face facing the direction from which the lower sash will approach. When the lower sash contacts the tapered face, it will press the tab inwards to allow the window to pass, but also at the same time the lower sash will provide the second "push" to activate the release of the tab which will then be biased by the spring 139 against the face of the sash frame, as the sash moves past the tab. When the sash is moved back to its closed position, and passes the device 120, the tab 124 will be free to move to its fully extended position where it blocks movement of the sash past the tab.

To enable the window to be opened, the user must push the tab in so that it locks in the retracted position.

The devices described are just two examples of sash window restrictors. It is important that the restrictor, once retracted to allow the window to be fully opened, automatically resets itself so that when the window is closed, the tab of the restrictor automatically moves into its window restricting position.

The tab can be any shape which can prevent movement of one sash past the other, and the term "tab" is not intended to limit the possible forms of this component.

There may be sash restricting devices of this type on one side of a window, or on both sides of the window. If there are safety requirements requiring at least two manual operations before a window can be fully opened, these requirements can be met by fitting a device as described here on both sides of the window. Alternatively (or additionally) the or each device can be provided with a secondary lock which locks the tab in the extended position and requires manual operation to release that lock before the tab can be pushed in.

As shown in FIG. 6 to FIG. 9, a preferred embodiment of a sash window restrictor 120 comprises a tab 124 which is pivotally mounted in a housing 122. The tab provides a first arm 110 and a second arm 112 located on either side of the pivot member 114. A torsion spring 116 is provided which urges the first arm from a first retracted position to a second extended position. The first arm 110 also includes a magnet 118 which is arranged in use to engage with a part of the housing 122 which thereby comprises a magnetic material. The housing may comprise a magnetic material or may have a specific magnetic element mounted therein.

Figure 10:
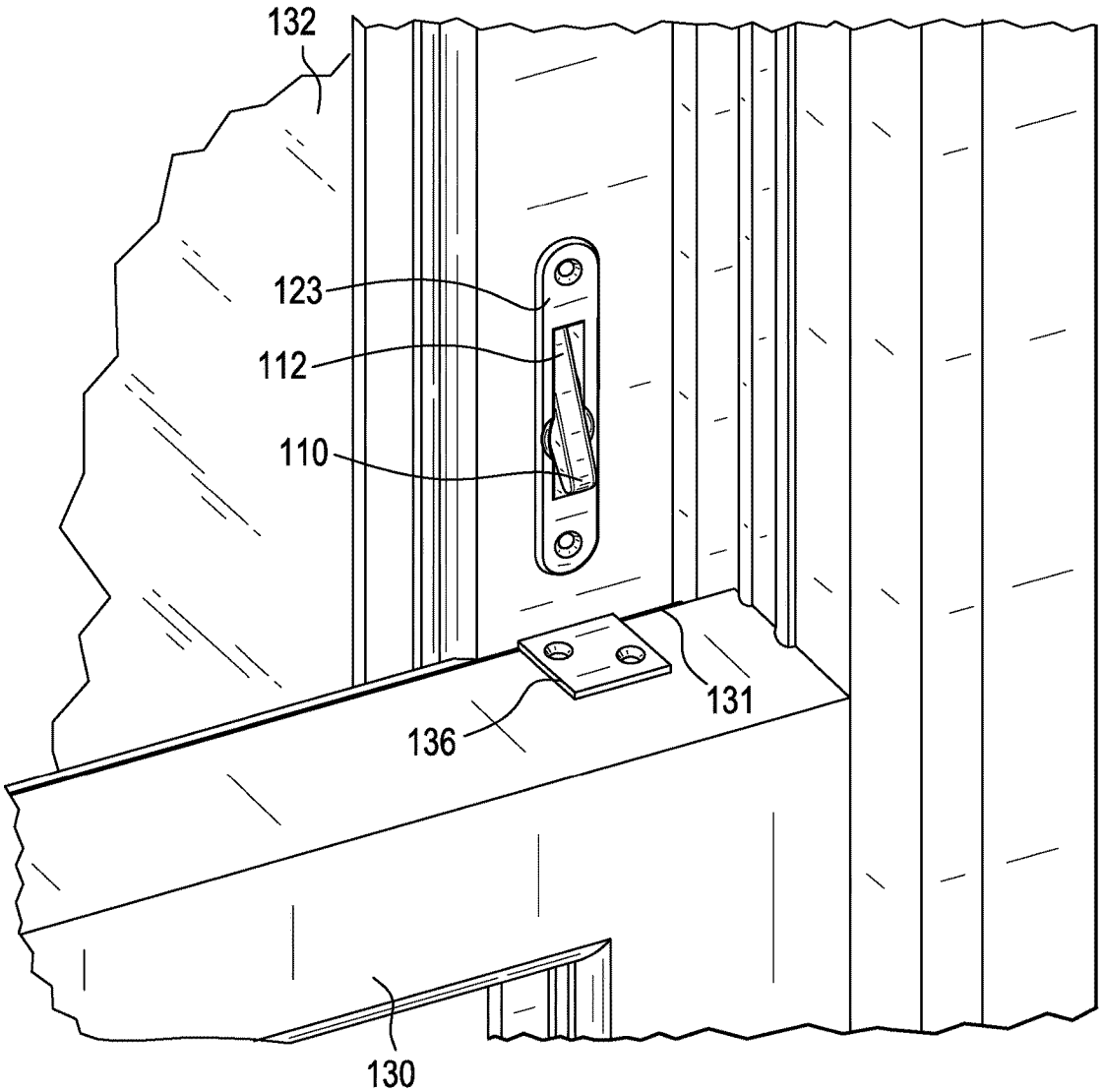
FIG. 10 is a perspective view of a preferred embodiment of a sash window restrictor mounted to a sash window assembly.
Figure 11:
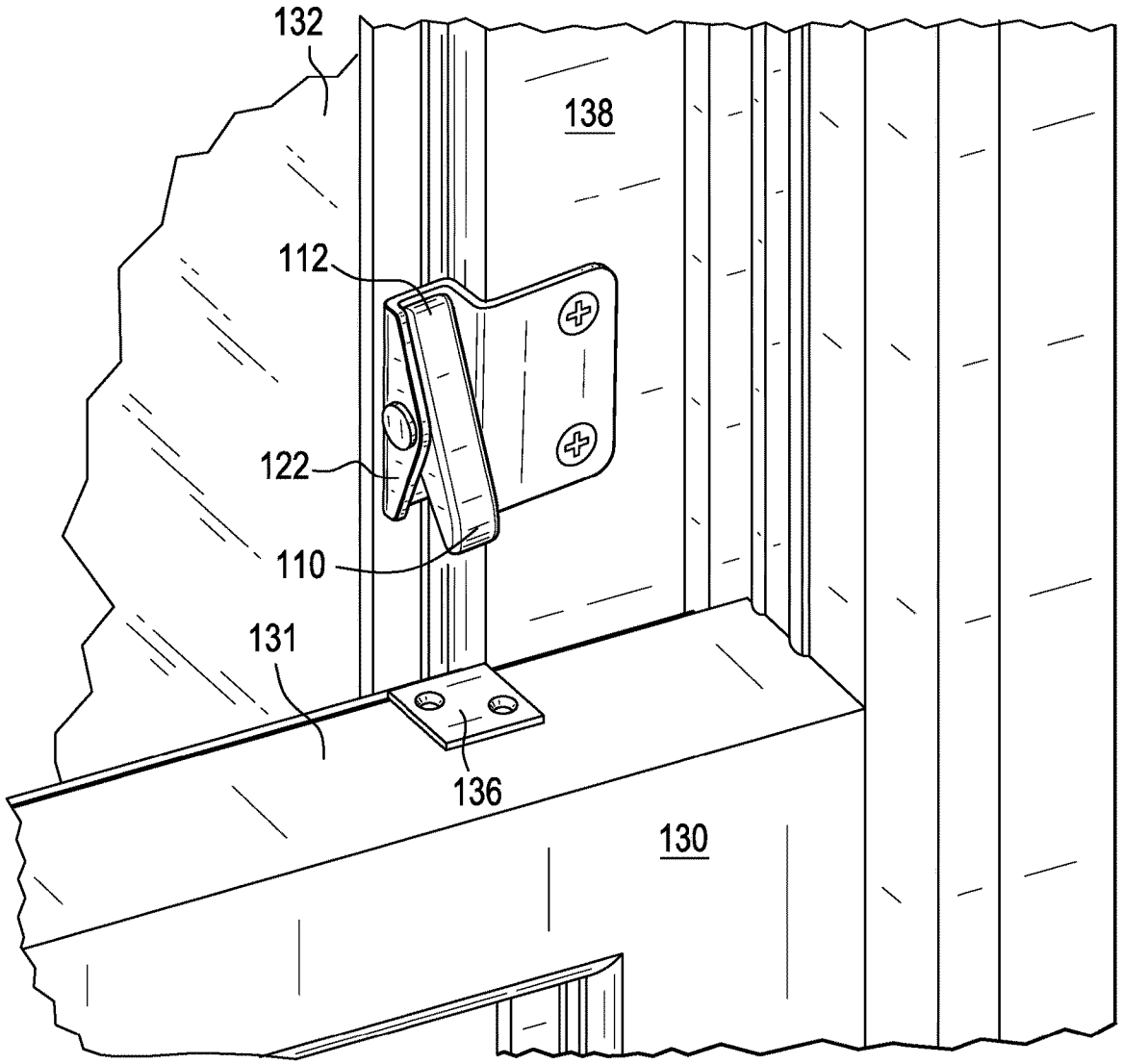
FIG. 11 is a perspective view of another embodiment of a sash window restrictor mounted to a sash window assembly.
Figure 12:
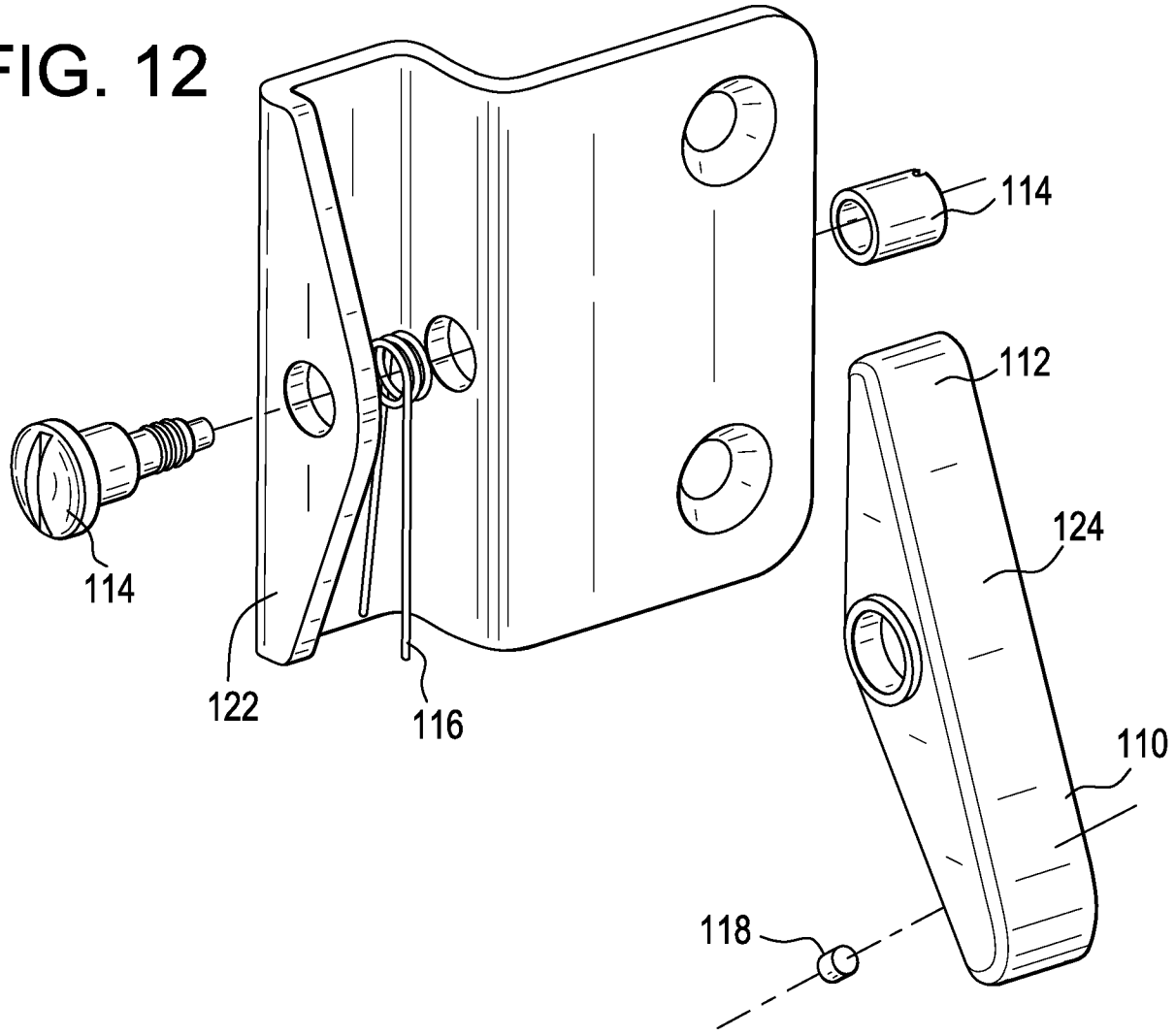
FIG. 12 is an exploded view of another embodiment of a sash window restrictor.

The sash window restrictor 120 is arranged in use to be mounted to a sash window assembly and is arranged to be mounted to a lower part (or lower frame member) of the upper sash and is mounted as an inset such that the housing plate 123 is substantially flush with the outer surface of the lower part (or frame member) of the upper sash, as shown in FIG. 10. In particular, the sash window restrictor is arranged to be inset into the surface of timber or UPVC sashes.

In use, a user pushes the first arm 110 inwardly into the housing 122 in order for the magnet 118 to engage with the magnetic material of the housing 122 and for the tab 124 to be held in a retracted position. The lower sash window 130 can then be moved upwardly relative to the upper sash window 132. When the tab 124 is held in the retracted position, the second arm 112 of the tab 124 projects outwardly from the housing 122 such that an upper part 131 (or upper frame member) will contact the second arm 112 in order to unlatch the magnet 118. The torsion spring 116 then urges the tab 124 to extend. Movement of the upper sash window 132 over the first arm 110 is insufficient to engage the magnet 118 with the housing 122. Accordingly, once the lower sash window 130 has returned to the lower closed position the tab 124 automatically extends to restrict upwards movement of the lower sash window 130 relative to the upper sash window 132. A reinforcement plate 136 is mounted on an upper part of the lower sash window 130 in order to provide a reinforced contact area which is arranged to contact the tab 124 to prevent or inhibit the lower sash window from being opened.

In another embodiment of the present invention as shown in FIG. 11 to FIG. 16, the sash window restrictor 120 is a surface mounted device which is arranged to be mounted to a side frame member 138 of an upper sash window 132.

The first arm 110 of the tab 124 normally projects out at an angle at the bottom of the sash window restrictor 120 and is held out by a torsion spring 116 which prevents the sash being raised beyond a chosen height. To allow the sash to be raised fully, the first arm 110 on the sash window restrictor 120 is pressed fully in until it is held in by magnetic contact. The second arm 112 of the tab 124 now projects so that when the sash is raised it pushes the second arm 112 inwards breaking contact with the magnet and allowing the spring 116 to push the first arm 110 up to the face of the sash. When the sash is lowered, as it passes the bottom of the first arm 110, the spring 116 pops the first arm 110 outwards and automatically resets it into the limiting position.

The version which sits at the side of the sash has the arm running along the surface of the glass rather than the surface of the sash frame.

In further embodiments of the present invention the latching mechanism may be provided by any suitable releasable latching means. For example, the latching means may comprise a plastic or metal snap feature to retain the first arm in the housing. Again the latching means is releasable by actuation as previously described.

Furthermore, the sash window restrictor may be lockable such that a lock mechanism protects and restricts the use and operation of the sash window restrictor.

There may also be locking versions of each type based on the same assemblies one using a key and another using a press button and further versions may use other suitable locking mechanisms. The press button version will automatically be set in the locked position and will have to have the button pressed to free the locking arm allowing it to be depressed and the sash to be opened. When the sash is closed the locking button will reset preventing the arm from being manually depressed. The key version will have to be manually unlocked with the key before the limiter can be used in the normal way and then locked with the key to make it secure.

The present invention is primarily applicable to sash windows and limiting or restricting the movement of a first sash window relative to a second sash window. However, the present invention can be used in other applications to prevent relative movement of a sash, for example the inset unit could be fitted into sliding patio doors to allow them to be opened a small distance while being secure.

In the descriptions of the embodiments that follow, like features have been have been indicated with numbers incremented by 100.

Figure 16:
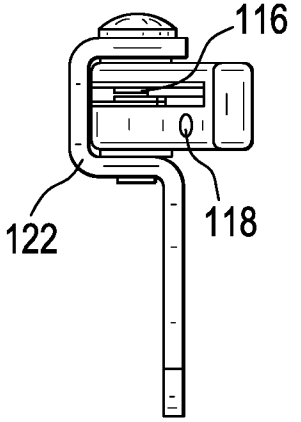
FIG. 16 is a bottom view of another embodiment of a sash window restrictor.
Figure 14:
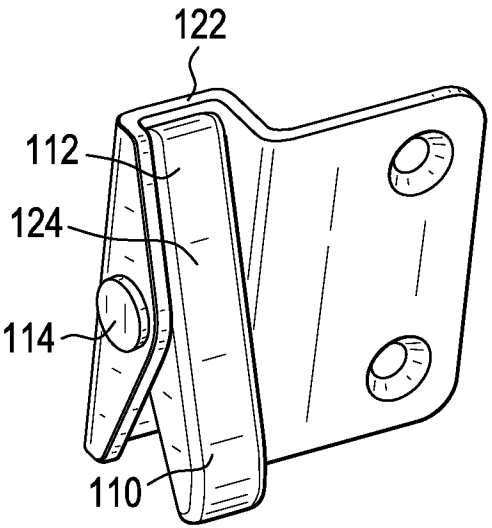
FIG. 14 is a front perspective view of another embodiment of a sash window restrictor.
Figure 15:
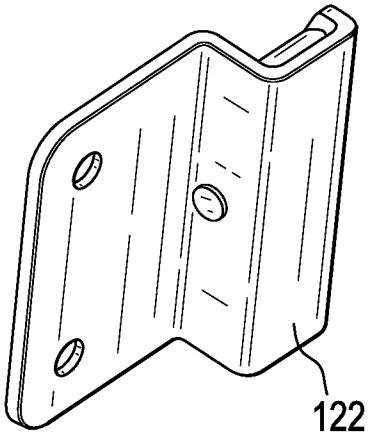
FIG. 15 is a rear perspective view of another embodiment of a sash window restrictor.
Figure 13:
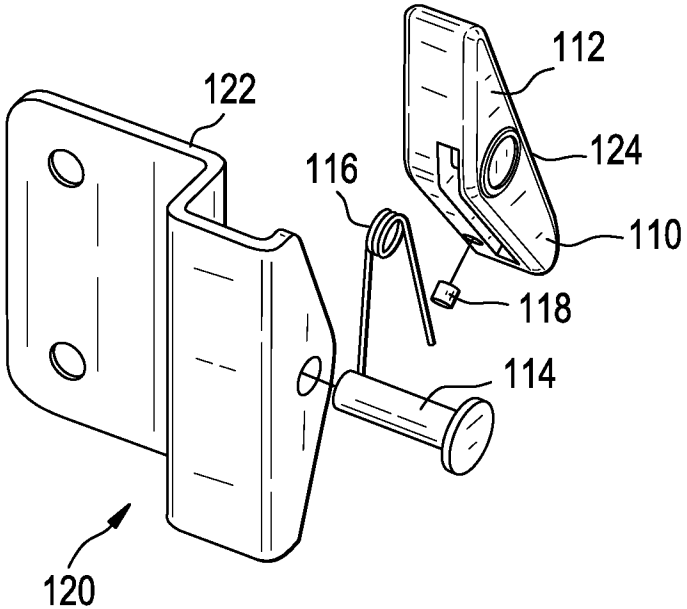
FIG. 13 is an exploded view of another embodiment of a sash window restrictor.
Figure 17:
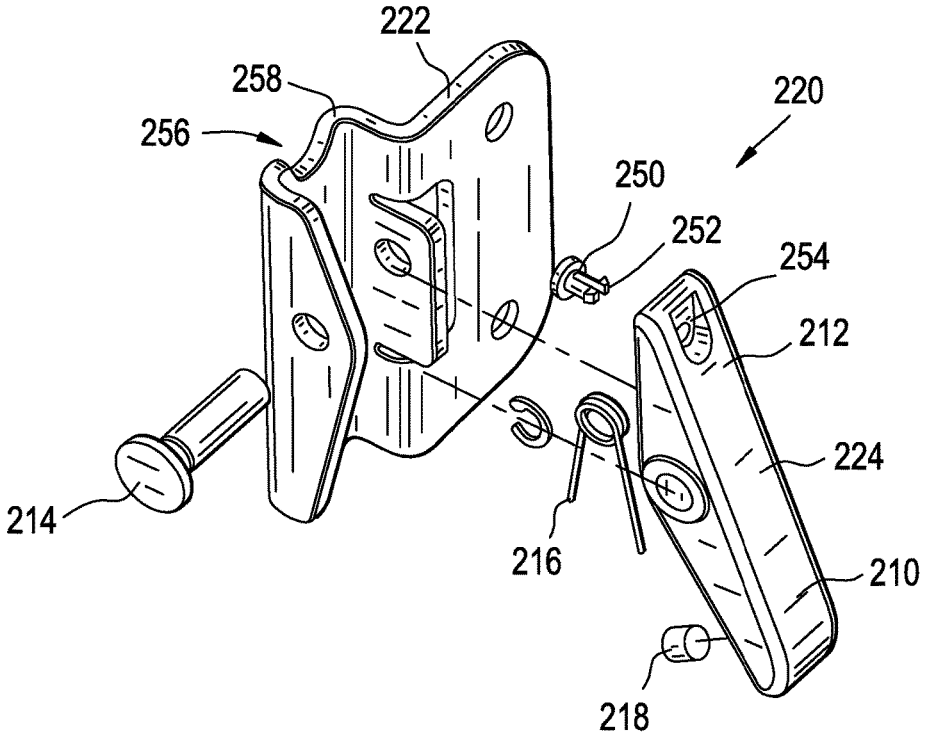
FIG. 17 is an exploded view of another embodiment of a sash window restrictor.
Figure 18:
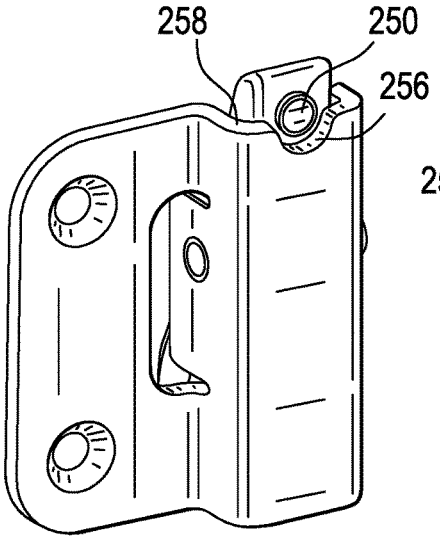
FIG. 18 is a front perspective view of the sash window restrictor of FIG. 17.
Figure 19:
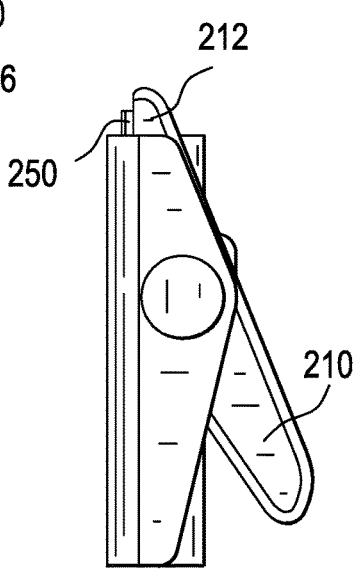
FIG. 19 is a side view of the sash window restrictor of FIG. 17.
Figure 20:
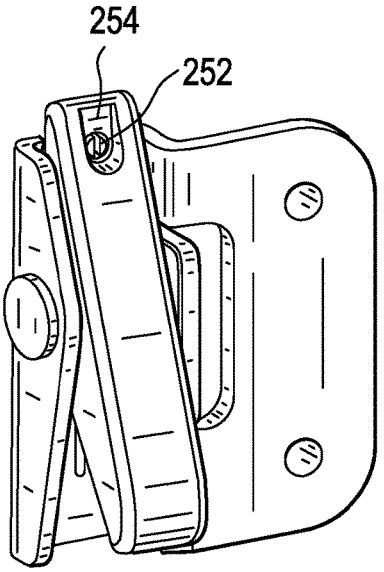
FIG. 20 is a rear perspective view of another embodiment of a sash window restrictor.
Figure 21:
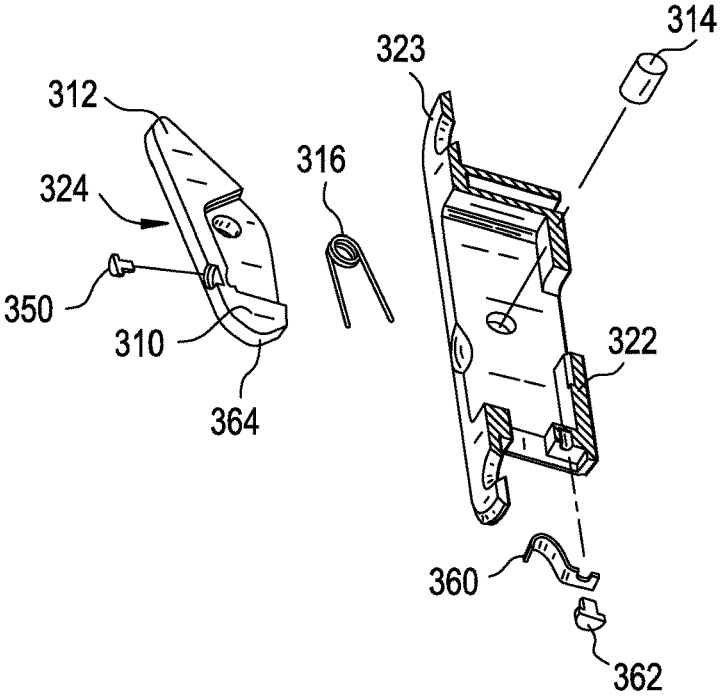
FIG. 21 is an exploded view of another embodiment of a sash window restrictor.
Figure 22:
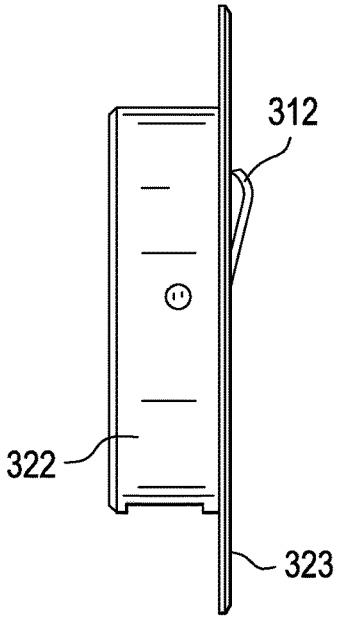
FIG. 22 is a side view of the sash window restrictor of FIG. 21.
Figure 23:
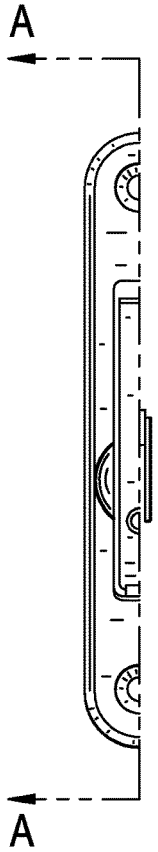
FIG. 23 is a sectioned front view of the sash window restrictor of FIG. 21.
Figure 24:
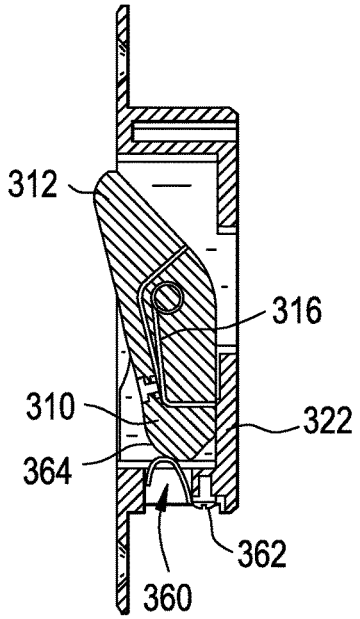
FIG. 24 is a section through the sash window restrictor of FIG. 23, along the line A-A.

FIGS. 17 to 20 show an embodiment of a sash window restrictor of the present invention that is similar to the embodiment shown in FIGS. 113 to 16. The sash window restrictor 220 of this embodiment includes an indicator 250 present in the second arm 212 of the tab 224. The indicator 250 may take the form of a red coloured disc that is visible from a front side of the restrictor 220. The indicator disc 250 is clearly visible by a user of the restrictor when the first arm 210 of the tab 224 is in an extended position thereby preventing upward movement of the sash. This is a safety feature to provide a warning that the window sash cannot be lifted without first retracting the first arm 210 of the tab 224, which may be achieved by pushing on or near the indicator disc 250 in the second arm 212. In this example, the indicator disc 250 comprises a retaining member 252 that sits in a recess 254 in the second arm 212. So that the whole of the indicator disc 250 is visible to a user of the device 220, a cut-out 256 is provided in a top edge 258 of the housing 222. In this case the cut-out 258 is semi-circular.

A further embodiment of the invention is shown in FIGS. 21 to 24. In this embodiment, the latching means 360 used to hold the first arm 310 in a retracted position takes the form of a spring 360 that engages with a lower edge 364 of the first arm 310 of the tab 324. In this example the spring is a leaf spring 360, but the latching means may be any other form of spring or resilient member. In one embodiment, the housing may be provided with a ball detent to retain the first arm 210 in a retracted position. The leaf spring 360 is held in position in the housing 322 by a small screw 362. The spring 360 may be held using any suitable means such that one end of the spring 360 is immovably fixed to the housing 322.

When the first arm 310 of the tab 324 is retracted and pushed inside the housing 322, the lower edge 364 of the first arm 310 rides over an upper end of the leaf spring 360. In this example, the upper end of the leaf spring 360 is curved to provide a smooth engagement surface with the end 364 of the first arm 310. In the retracted position, the first arm 310 is held within the housing 322 such that the end 364 of the first arm 310 is behind the leaf spring 360. When the second arm 312 is pressed, due to the movement of the window sash, the tab 324 pivots about the pivot member 314 and the first arm 310 is forced past the leaf spring 360 by the action of the torsion spring 316.

In this embodiment, an indicator 350 is provided in a front face of the first arm 310 of the tab 324. The indicator 350 has the same function as described hereinbefore.

Figure 25:
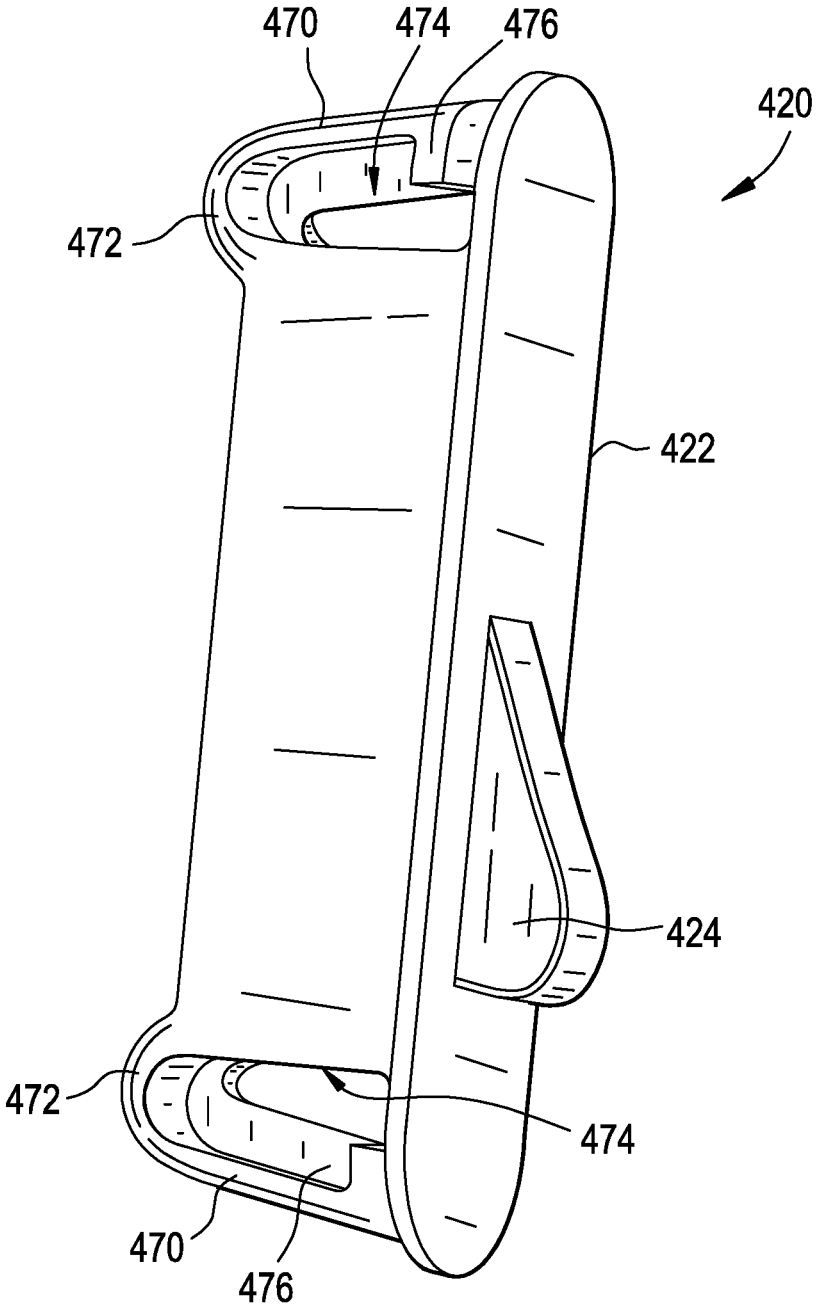
FIG. 25 is a perspective view of a push fit securement embodiment of a sash window restrictor.

FIG. 25 shows a push fit embodiment of the present invention. This embodiment enables the sash window restrictor 420 to be quickly and easily secured in a frame member and, in particular, in a hollow upvc window frame member. The housing 422 includes two retaining members, in this example retaining arms 470, one at each end 474 of the housing 422. The arms 470 are resilient members and are connected to the housing 422 by a first section 472 of the arm 470 in such a way that this section 472 of the arm 470 forms a hinge 472 and the arms 470 lie parallel with the ends 474 of the housing 422. In this way, when the restrictor 420 is pushed into the frame member, the arms 470 are pressed towards the housing 422 causing the hinges 472 to bend. The energy stored in the hinge sections 472 of the arms 470 urges the arms 470 outwards once the restrictor is placed in the frame member holding the restrictor within the frame. In particular, when the restrictor 420 is installed in a hollow upvc frame, the hole cut in the frame is such that as the restrictor 420 is pushed into the frame, the arms 470 are pressed in towards the housing 422. Once fully in the frame, the arms 470 are urged outwards by the action of the hinges 472 into the hollow of the frame thereby preventing the restrictor 420 from being pulled out. As shown in FIG. 25, the arms 470 may include a projection 476 at the second end of the arm 470. These projections 476 limit the distance the arms 470 can be pressed inwards which prevents the hinge 472 being bent too much.

Figure 26:
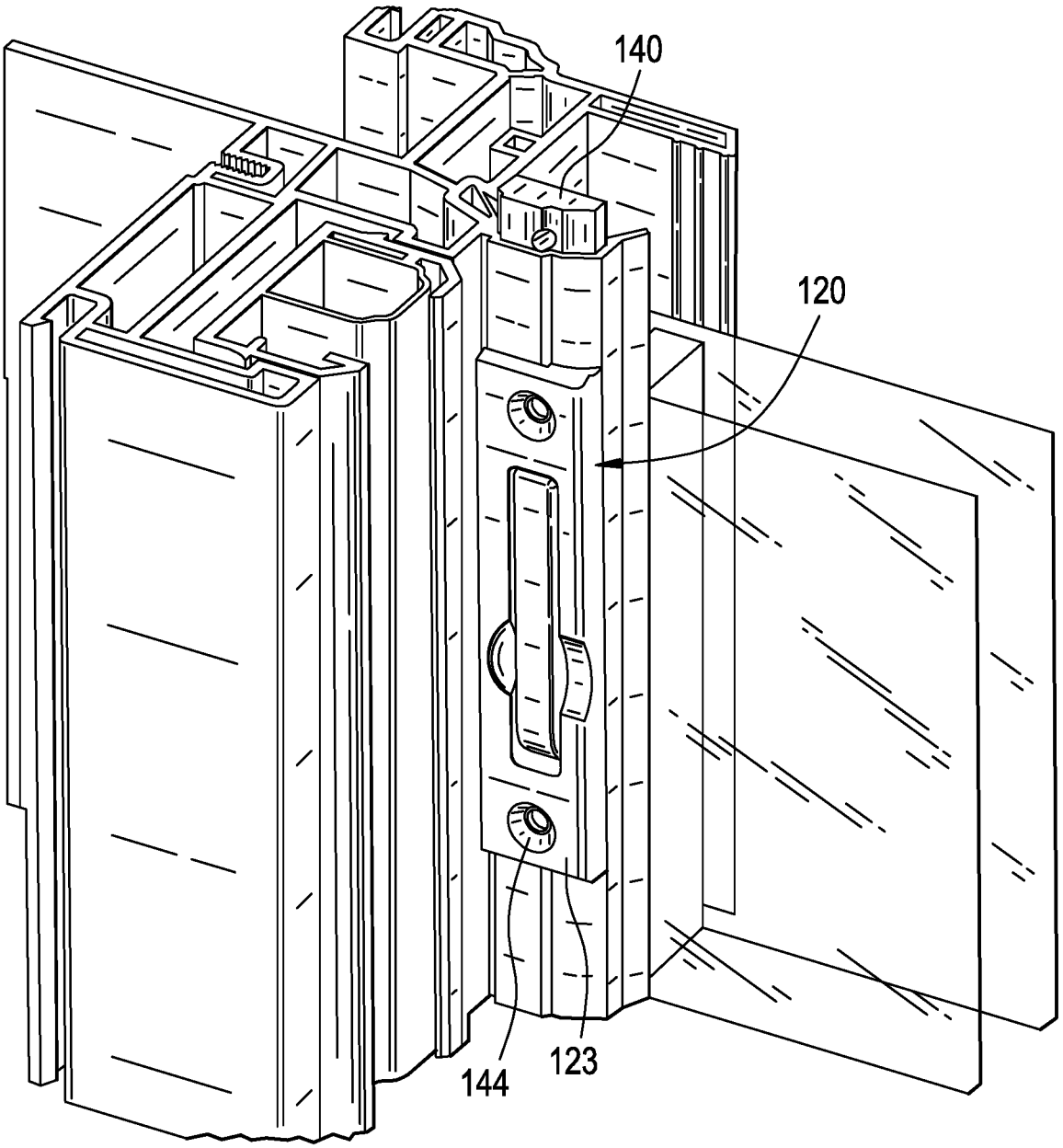
FIG. 26 is a perspective view of an insert for mounting a sash window restrictor.
Figure 27:
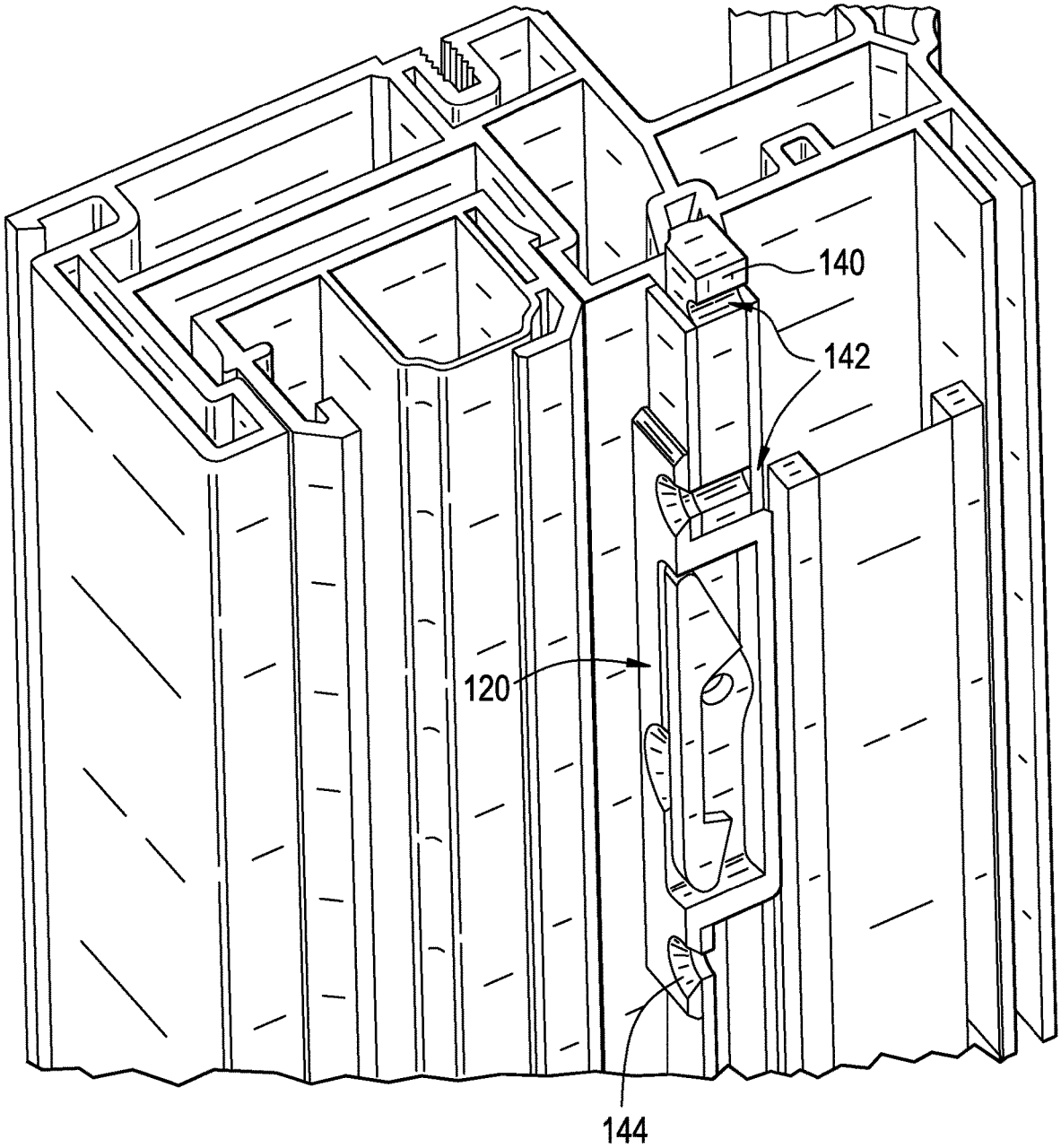
FIG. 27 is a sectional view of the insert of FIG. 26.
Figure 32:
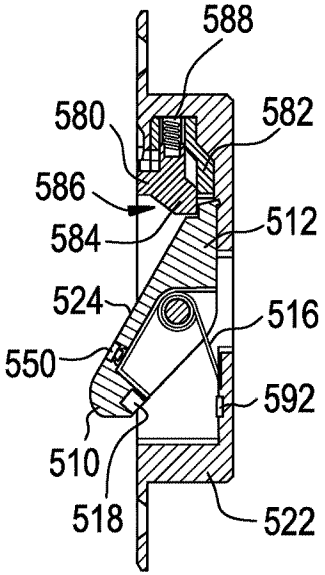
FIG. 32 is a sectional view of the sash window restrictor of FIG. 30 along the line B-B.
Figure 31:
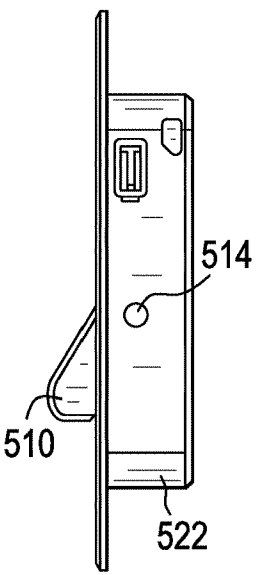
FIG. 31 is a side view of the sash window restrictor of FIG. 28.
Figure 30:
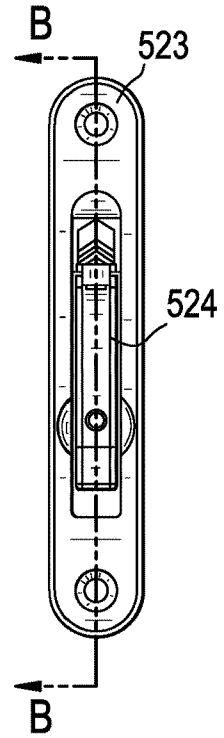
FIG. 30 is a front view of the sash window restrictor of FIG. 28.
Figure 29:
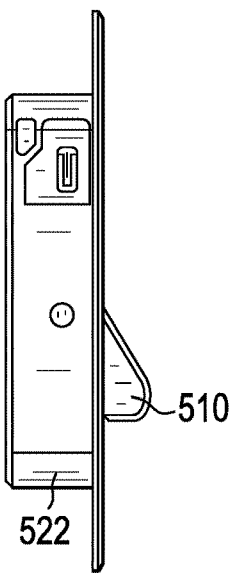
FIG. 29 is a side view of the sash window restrictor of FIG. 28.
Figure 28:
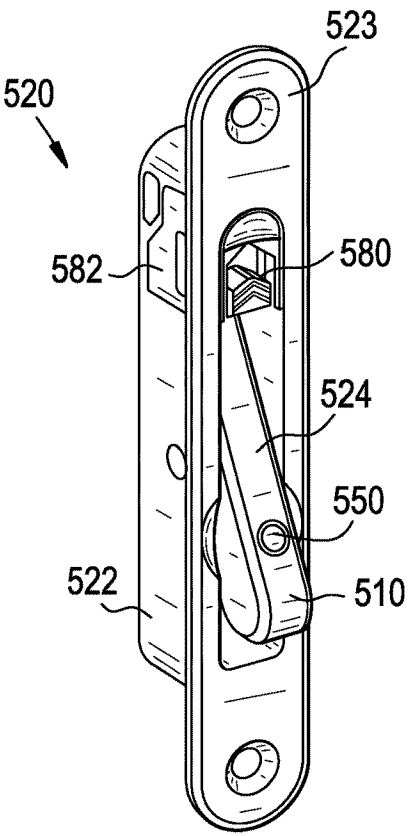
FIG. 28 is a perspective view of a front mounted sash window restrictor according to another embodiment of the invention.

In other embodiments, it may be required to fix a restrictor 120 to a hollow upvc frame using screws. In this case, it is necessary to provide an insert 140 that fits within the hollow space of the frame. As shown in FIGS. 26 and 27, this insert 140 takes the form of a bar or plate having through-thickness cylindrical holes 142. These cylindrical holes 142 align with the screw holes 144 present in the housing plate 123 and accommodate the shaft of the screw when the restrictor 120 is fixed in place. At least one face of the insert 140 may be shaped so that its profile is substantially the same as that of the upvc frame.

It will be appreciated that any of the embodiments of a sash window restrictor described so far may include locking means which locks the tab in the extended position. As described hereinbefore these locking means are designed such that a manual operation, for example the pressed or sliding of a button, is required to release that lock before the tab can be pushed in. Such locking means provide a dual action requirement for each single sash window restrictor.

As explained above, the operation of the sash window restrictor may comprise a single action although as mentioned above the opening of the window may require a double action or dual action restricting mechanism. In order to provide a dual action sash window restrictor means, the sash window may be provided with two separate single action sash window restrictors. Alternatively, the sash window restrictor is provided with a dual action requirement. For example, the sash window restrictor may be provided with a locking button that must be moved out of engagement with the tab to allow the tab to initially be pressed into the housing. In particular, the button is slid out of engagement with the tab to enable the tab to be pressed in which thereby provides a dual action requirement. The locking button is also arranged to automatically reset.

Further embodiments of a sash window restrictor will now be described that include locking means.

FIGS. 28 to 33 show an embodiment of the present invention that is similar to the embodiment shown in FIGS. 6 to 9. In this case, the restrictor 520 includes a slidable locking member 580. The locking member 580 slides within a lock housing 582 fixed into the housing 522 of the restrictor 520.

The locking member is arranged to engage with the second arm 512 of the tab 524. The locking member 580 is a substantially rectangular block having a locking foot 584 projecting at an angle from one end of the block. This locking foot 584 is designed to engage with a recess 586 in the second arm 512 of the tab 524 to hold the second arm 512 within the housing 522 and retain the first arm 510 in an extended position, as shown most clearly in FIG. 32.

At an opposite end of the locking member 580, biasing means, in this case a compression spring 588, is located between the locking member 580 and a part of the housing 522. In this example, the compression spring 588 extends through the lock housing 582, however, alternatively, the compression spring 588 may be located between the locking member 580 and a part of the lock housing 582. The compression spring 588 acts to bias the locking member 580 towards the tab 524, and in particular towards the second arm 512 of the tab 524.

In order to retract the first arm 510 of the tab 524 and push the first arm 510 within the housing 522, the locking member 580 must first be disengaged from the second arm 512.

In this way, when the first arm 510 of the tab 524 is projecting out from the housing 522 of the sash window restrictor 520 to prevent a window sash being raised beyond a chosen height, the locking foot 584 is engaged in the recess 586 in the second arm 512 of the tab 524 and is held in this position by the action of the compression spring 588. To allow the sash to be raised fully, the locking member 580 must first be slid in a direction away from the tab 580, in this example in an upwards direction into the lock housing 582. With the locking foot 584 removed from the recess 586, the first arm 510 on the sash window restrictor 520 can then be pressed fully in until it is held in by magnetic contact, as described hereinbefore. Once a user has released the locking member 580, the compression spring 588 urges the locking member 580 downwards so that the locking foot 584 extends behind the second arm 512 of the tab 524.

In this position, the second arm 512 of the tab 524 now projects outwards so that when the sash is raised it acts to push the second arm 512 inwards. A rear edge of the second arm 512 contacts a sloping face 590 of the locking member 580 and the locking member 580 slides upwards over the second arm 512. As the second arm 512 moves further inside the housing 522, the locking member 580 slides over the tip of the second arm 512 and the locking member 580 is then urged towards the second arm 512 and the locking foot 584 engages in the recess 586.

In addition, in this embodiment, the magnet 518 located in the first arm 510 engages with a second magnet 592 that is fixed to the housing 522. The two magnets 518, 592 are oriented so that opposite poles of the magnets 518, 592 make touching contact when the first arm 510 moves inside the housing 522.

Figure 34:
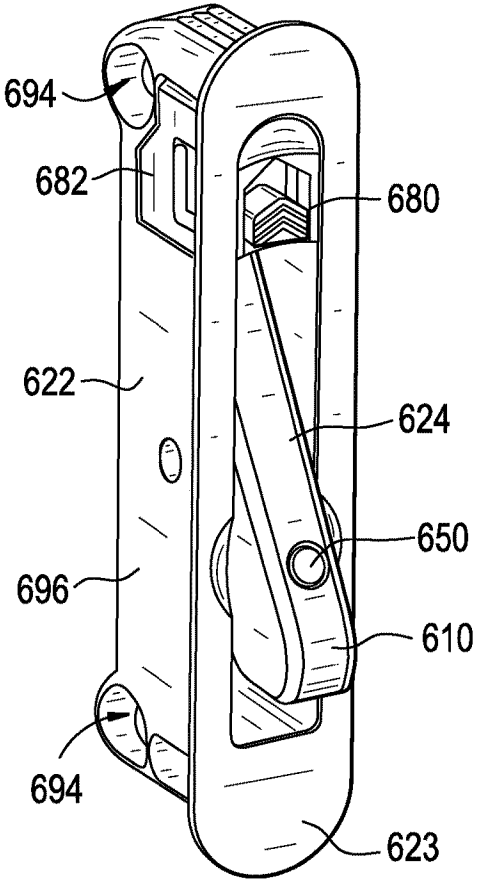
FIG. 34 is a front perspective view of a side mounted sash window restrictor according to another embodiment of the invention.
Figure 33:
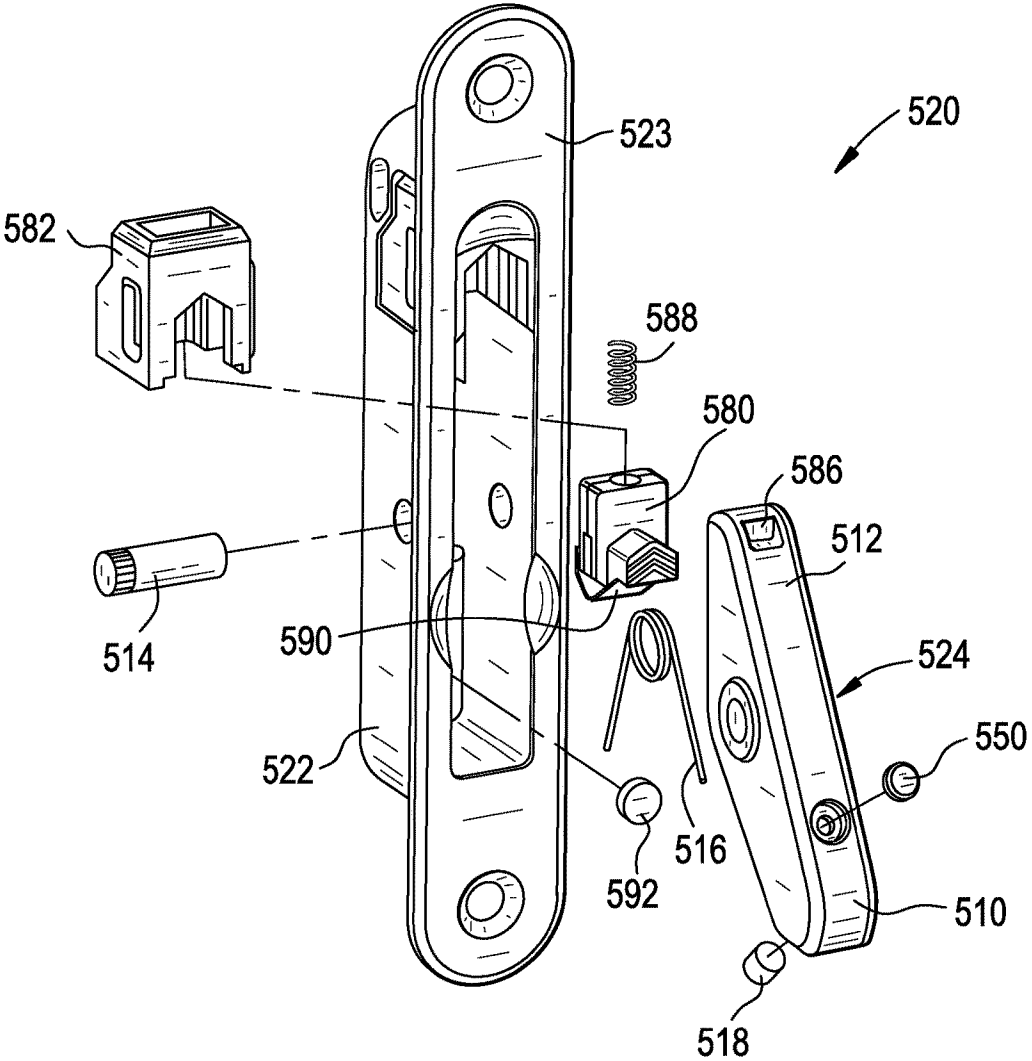
FIG. 33 is an exploded view of the sash window restrictor of FIG. 28.

A further embodiment shown in FIG. 34 is substantially the same as the embodiment shown in FIG. 33 but differs in the means for fixing the sash window restrictor to a frame. The sash window restrictor shown in FIG. 33 is front-mounted and fixed to a frame by means of the housing plate 523, in particular by screws that pass through holes in the mounting plate 523 and into the frame of the window. The embodiment shown in FIG. 34 does not include fixing means in the housing plate 623, and instead is fixed within a frame by screws or similar that pass through channels 694 in a rear part 696 of the housing 622.

Figure 37:
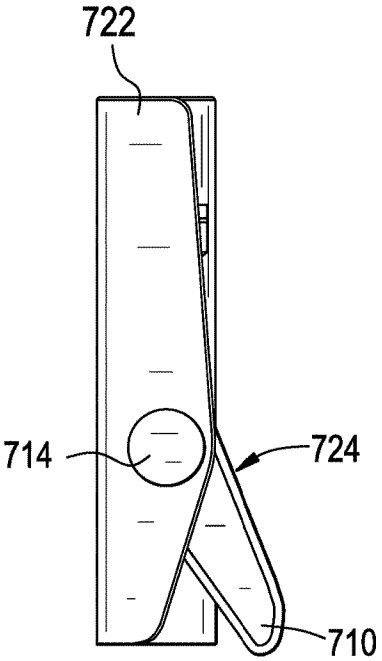
FIG. 37 is a side view of the sash window restrictor of FIG. 35.
Figure 36:
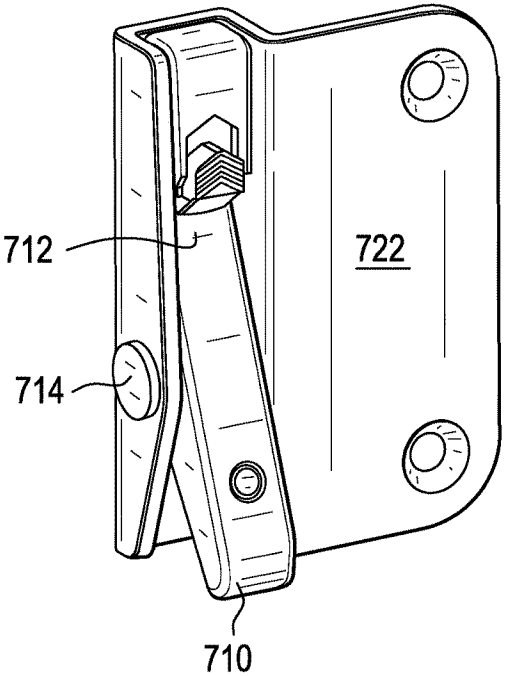
FIG. 36 is a front perspective view of the sash window restrictor of FIG. 35.
Figure 35:
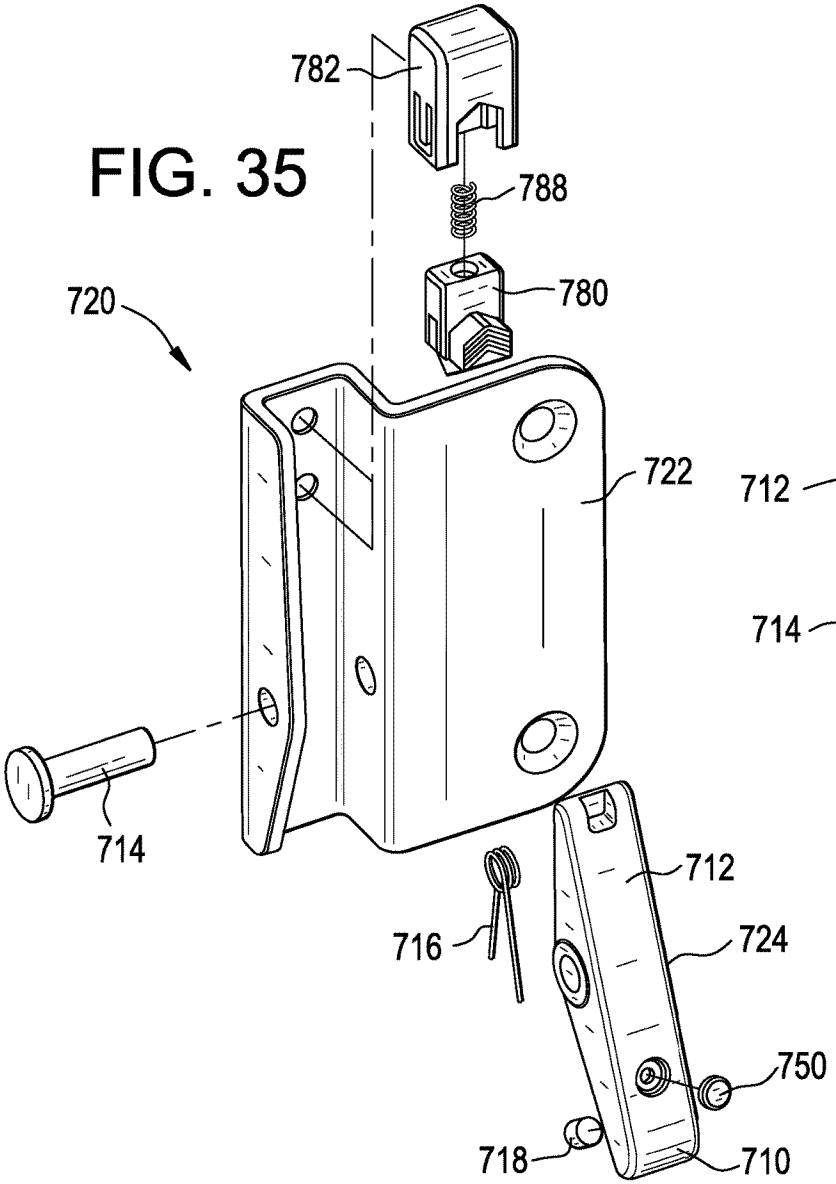
FIG. 35 is an exploded view of a sash window restrictor according to another embodiment of the invention.
Figure 38:
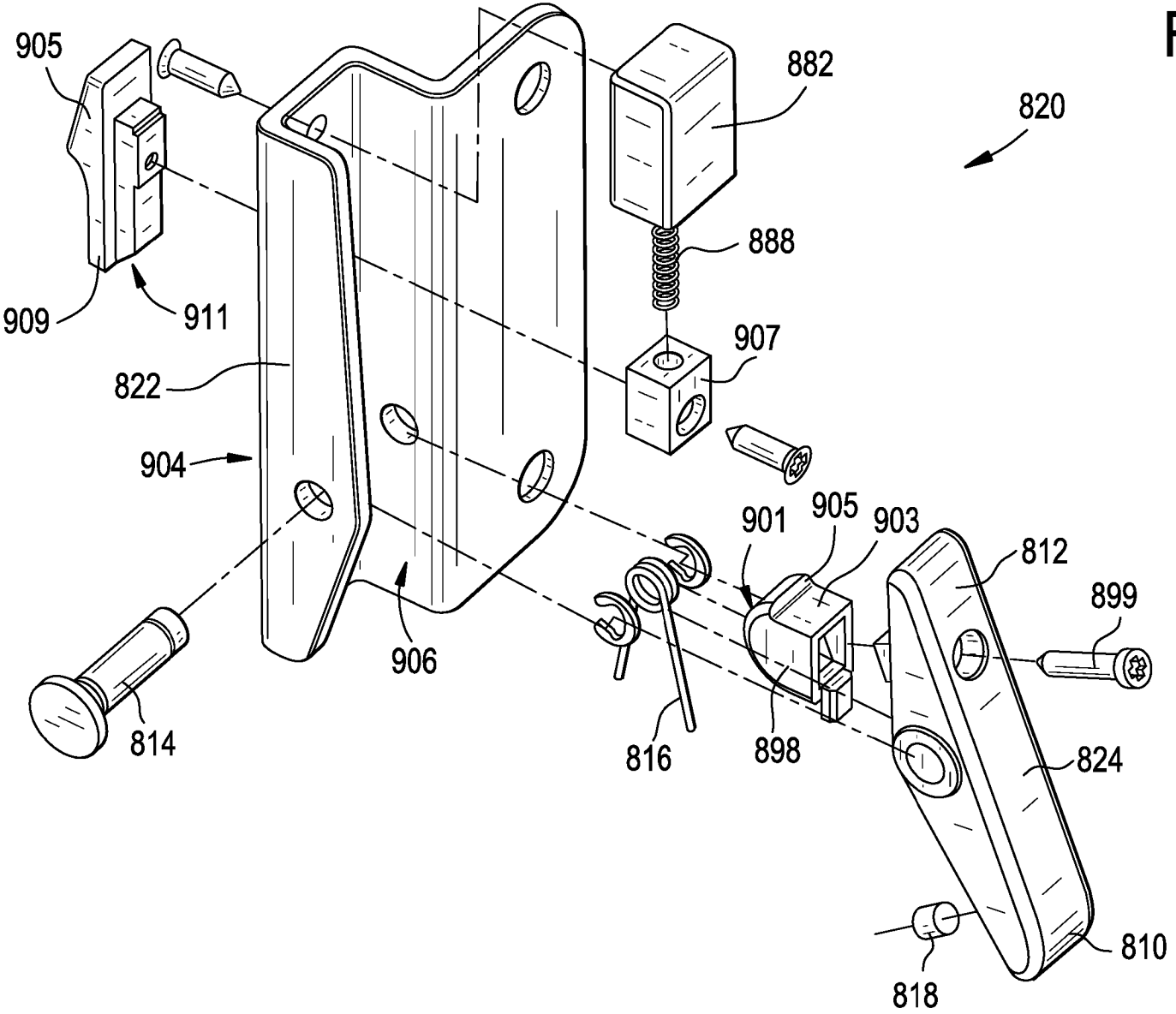
FIG. 38 is an exploded view of a sash window restrictor according to another embodiment of the invention.

FIGS. 35 to 37 illustrate an embodiment of a sash window restrictor 720 that is substantially similar to the embodiment shown in FIGS. 28 to 32, however, in this case, the housing 722 is such that the restrictor 720 may be fitted to the outside of a window frame. This has the advantage that the restrictor may be easily retro-fit as it does not require the restrictor to be mounted within the frame of the window.

Figure 42:
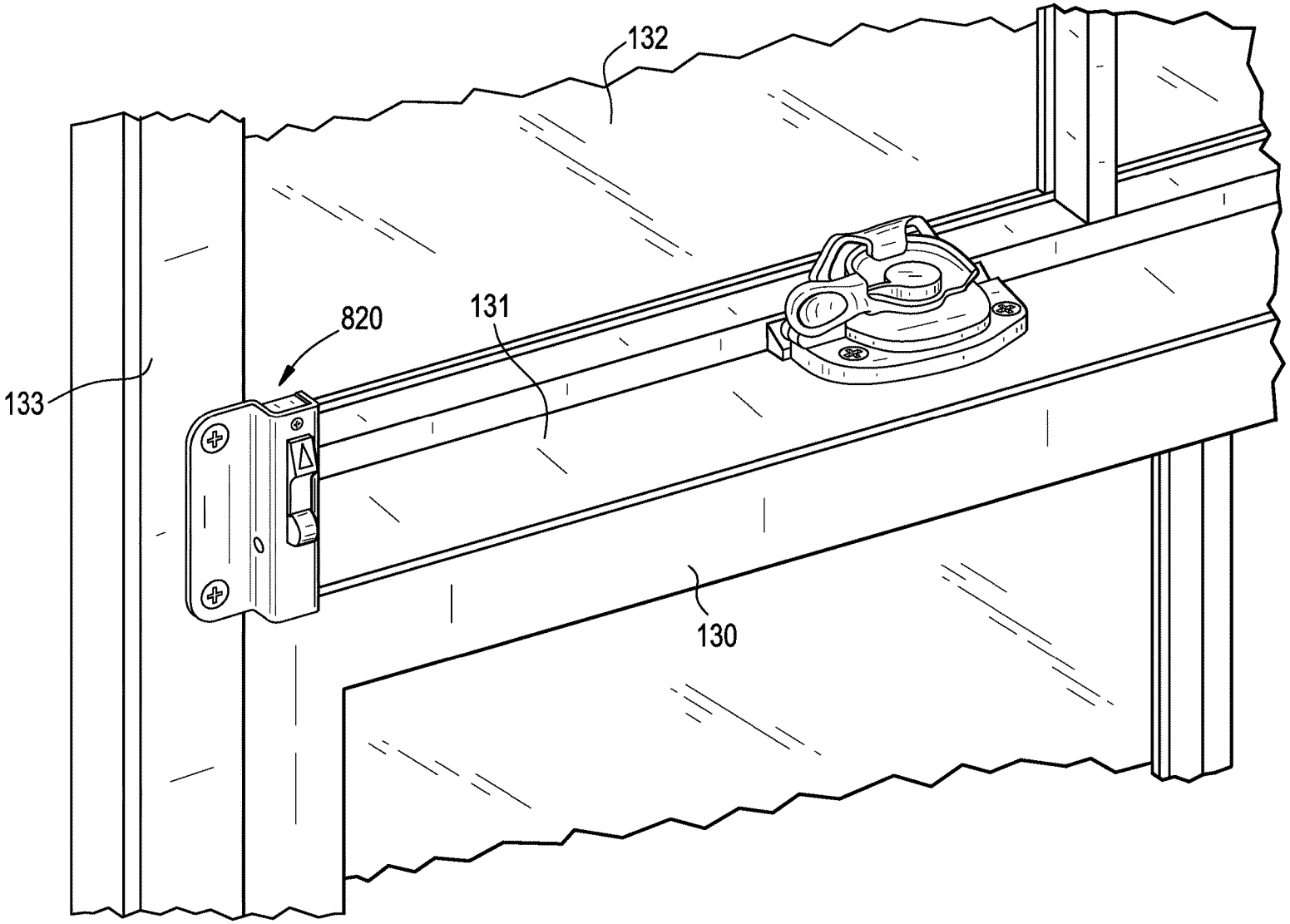
FIG. 42 shows the sash window restrictor of FIG. 38 mounted on a window frame.
Figure 43:
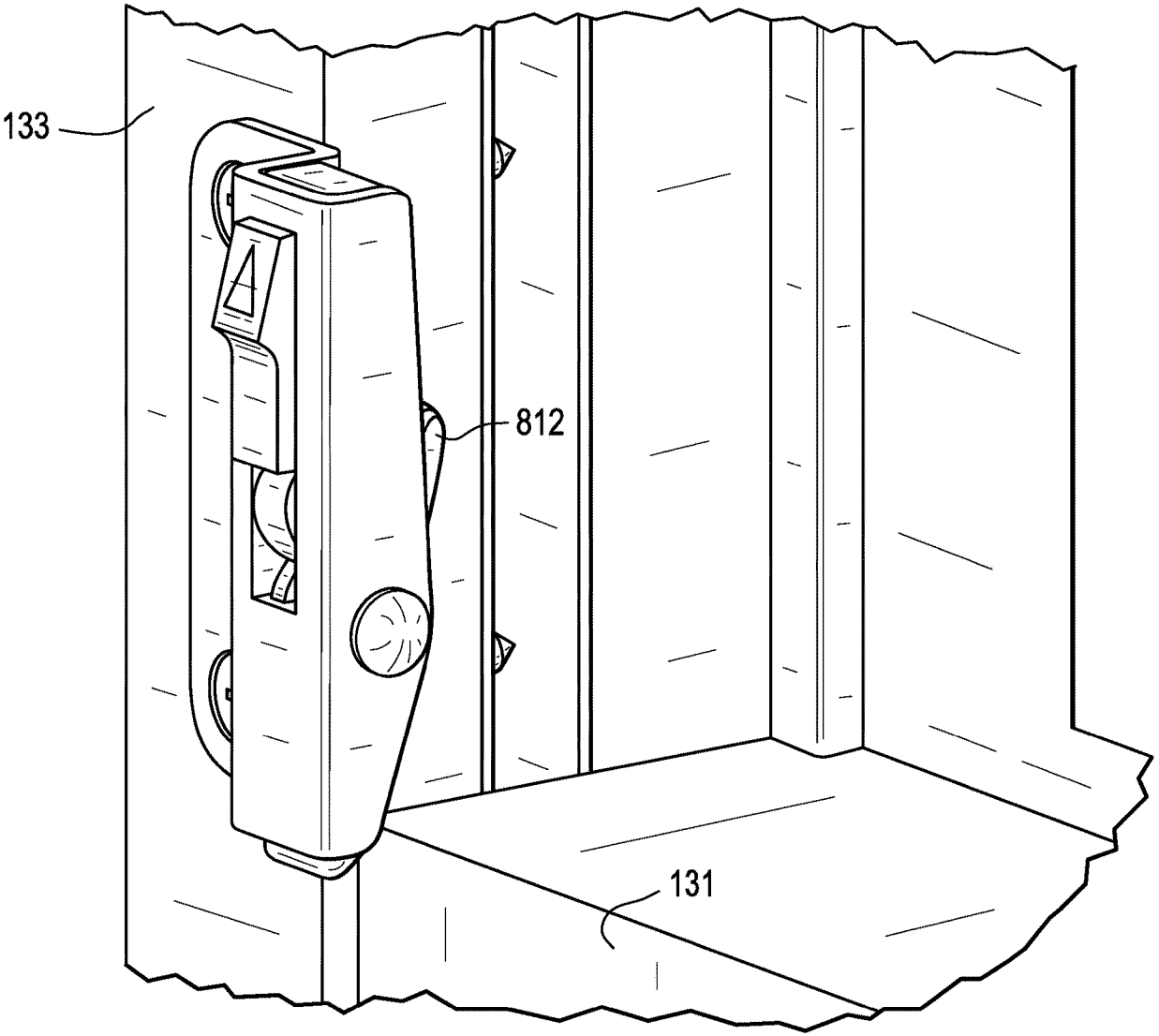
FIG. 43 shows the sash window restrictor of FIG. 42 with the tab retracted.
Figure 44:
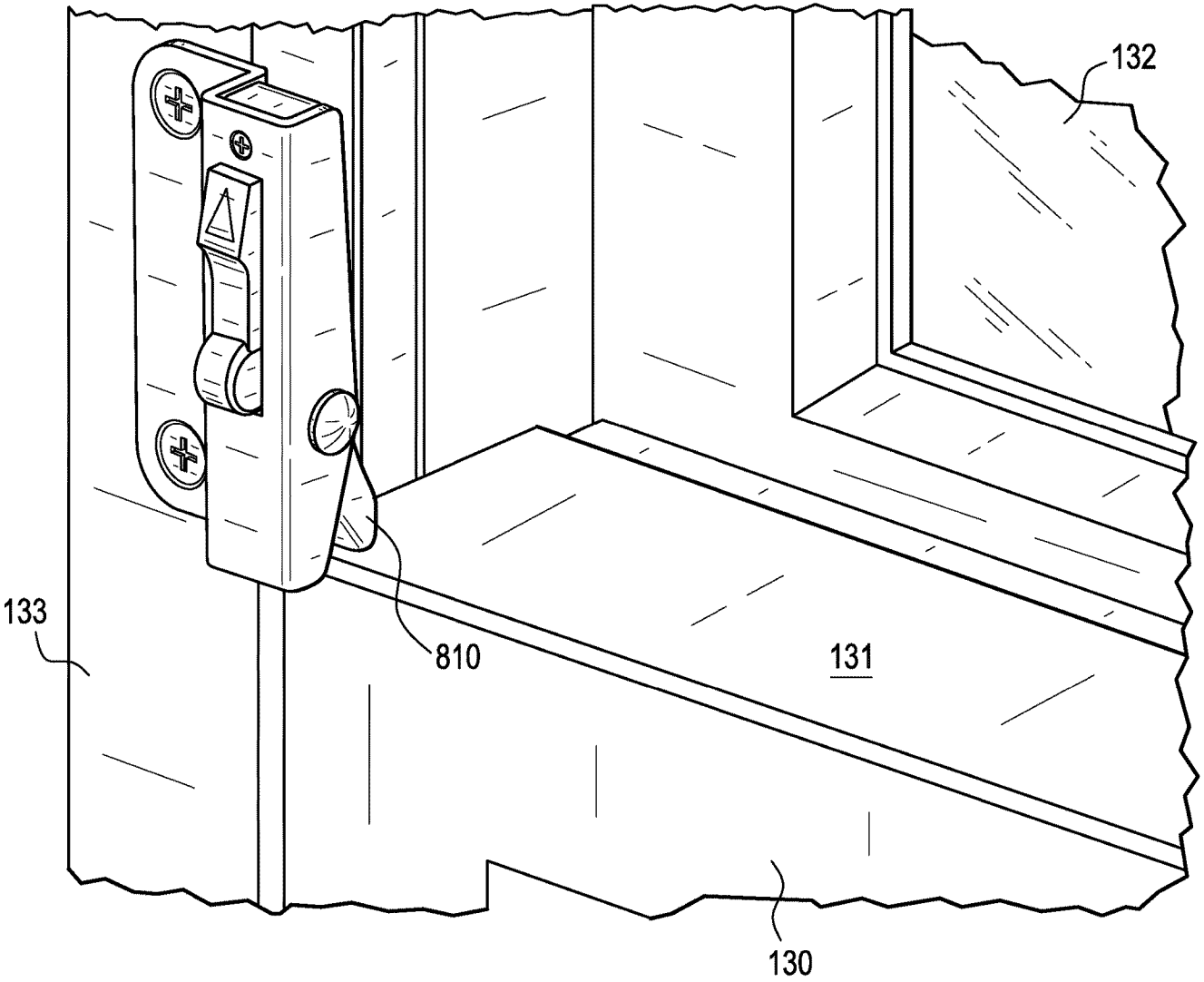
FIG. 44 shows the sash window restrictor of FIG. 42 with the tab extended.

A further embodiment of a sash window restrictor having a lock mechanism is shown in FIGS. 38 to 44. Similarly to the previous embodiment, the housing 822 is shaped so that the restrictor 820 may be fitted to an outer frame 133 of the window, with the first arm 810 of the tab 824 contacting an upper part 131 of a lower sash as illustrated in FIGS. 42 to 44.

In this embodiment, a button 898 is attached to the second arm 812. The button may be attached to the second arm 812 using any suitable means, but in this example it is fixed to the second arm 812 using a screw 899. The button 898 is substantially cuboid, with the face opposing the second arm being curved 901 in one direction. The end of the curved surface 901 stands proud of a top face 903 of the button 898 thereby forming a lip 905. The tab 824 is pivotally mounted in the housing 822 such that at least a part of the button 898 protrudes through the housing 822 and is visible from a front side 904 of the housing 822. In this arrangement, the arms 810, 812 of the tab 824 protrude from a rear side 906 of the housing 822.

In this embodiment, the slide member 880 comprises a slide plate 905 and a mounting block 907. The slide plate 905 and mounting block 907 are joined rigidly together such that a part of the slide plate 905 is on a front side 904 of the housing 822, and the mounting block 907 is on the rear side 906 of the housing 882. As described previously, a lock housing 882 is fixed into the housing 822, and the mounting block 907 slides within this lock housing 882. Biasing means, in this case a compression spring 888, is located between the mounting block 907 and a part of the lock housing 882. The compression spring 888 acts to bias the locking member 580 towards the tab 524, and in particular towards the second arm 512 and the button 898.

When the first arm 810 of the tab 824 is projecting out from the housing 822 of the sash window restrictor 820 to prevent a window sash being raised beyond a chosen height, an end 909 of the slide plate 905 abuts the top surface 903 of the button 898. Movement of the second arm 812 and button is prevented by the lip engaging with the slide plate, as shown in FIG. 40. The slide plate 905 is held in this position by the action of the compression spring 888. To allow the sash to be raised fully, the locking member 580, and in particular the slide plate 905 is first slid in a direction away from the button 898, in this example in an upwards direction such that the mounting block 907 slides into the lock housing 882. Once the end of the slide plate is disengaged from the lip of the button, the button can then be pressed through the housing. Pressing the button in this way causes the tab to rotate about the pivot member 814 so that the first arm 810 on the sash window restrictor 820 is retracted until it is held by magnetic contact, as described hereinbefore. Once a user has released the slide plate 905, the compression spring 888 urges the locking member 880 downwards so that the end of the slide plate extends partly in front of the button. In this position a chamfered edge 911 of the slide plate 905 rests against the curved surface 901 of the button 898.

When the sash is raised it acts to push the second arm 812 inwards and the first arm 810 is extended from the housing 822 by the action of the torsion spring 816. As this happens, the curved surface 901 of the button 898 slides against the chamfered edge 911 of the slide plate 905 and forces the locking member 880 upwards until the tab 824 has rotated sufficiently to cause the end 909 of the slide plate 905 to drop down behind the lip 905 and lock the tab 824 in position as described previously.

The sash window restrictor may be mounted to any suitable part of the window or window frame including a window frame member, a sash member, a stile, a jamb etc.

If required, the assembly may include a bracket or abutment member which is arranged on the other part of the window assembly from the tab and provides a suitable placed abutment surface to abut with the tab to restrict the opening of the window.

The present invention is for use with all suitable sash windows, for example horizontal and vertical sliding sash windows.

The invention claimed is:

1. A restrictor for restricting movement of a sash window, the restrictor comprising:

a housing; and a tab, the tab is a one-piece unitary structure, so that the tab is rigid and all points in the tab move in unison without any other pieces moving, the tab is moveable relative to the housing between at least a first restricting position and at least a first retracted position, the restrictor is configured such that with the tab in the first retracted position, the tab is prevented from moving out of the first retracted position without any external force being exerted on any component of the restrictor, a portion of the tab extending from the housing in the first restricting position, at least a portion of the tab is in the housing in the first retracted position, the restrictor is configured such that the restrictor can be positioned relative to a sash window that has a flat front surface and a flat top surface, the flat top surface perpendicular to the flat front surface, such that:

an entirety of the window sash structure, other than the flat front surface, is to a first side of a first plane, and an entirety of the housing is to a second side of the first plane, with the tab in the first restricting position, the tab would prevent the sash window from being moved, relative to the restrictor from a first sash position to a second sash position in a movement sequence, the flat front surface moving in the first plane in a first direction during an entirety of said movement sequence, the first direction perpendicular to a plane defined by the flat top surface, with the tab in the first retracted position, the tab would not prevent the sash window from being moved relative to the restrictor from the first sash position to the second sash position in said movement sequence, and with the tab in the first retracted position, moving the sash window relative to the restrictor from the first sash position to the second sash position in said movement sequence would cause contact between the sash window and the tab during at least part of said movement sequence, and said contact between the sash window and the tab would cause the tab to move relative to the housing.

2. A restrictor according to claim 1, wherein the tab is automatically moved into the first restricting position when the sash window is returned from the second sash position to the first sash position.

3. A restrictor according to claim 1, wherein the restrictor further comprises at least a first pushing element, the first pushing element biasing the tab toward the first restricting position.

4. A restrictor according to claim 3, wherein:

the restrictor further comprises a restraining element which, when engaged, prevents the tab from being moved from the first retracted position toward the first restricting position by a force exerted by the first pushing element, and said contact between the sash window and the tab during at least part of said movement sequence would cause the restraining element to disengage so that the restraining element no longer prevents the tab from being moved from the first retracted position toward the first restricting position.

5. A restrictor according to claim 1, wherein with the sash window in the second sash position, contact between the sash window and the tab would prevent the tab from being moved from the first retracted position to the first restricting position.

6. A restrictor according to claim 1, wherein the tab is pivotally connected to the housing.

7. A restrictor according to claim 1, wherein the tab is moveable with respect to the housing to a second retracted position in which an entirety of the tab is in the housing.

8. A restrictor as recited in claim 1, wherein all points in the tab pivotally move in unison without any other pieces moving.

9. A restrictor as recited in claim 1, wherein all points in the tab move translationally in unison without any other pieces moving.

10. A restrictor as recited in claim 1, wherein for each pair of points on the tab, a distance between the points remains constant and cannot change.

11. A sliding system comprising:

a first member;

a second member, the second member having a first surface and a second surface, the second surface defining a first plane, the first surface defining a second plane substantially perpendicular to the first surface; and a restrictor, the restrictor comprising:

a housing; and a tab, the tab is moveable relative to the housing between at least a first restricting position and at least a first retracted position, the restrictor is configured such that with the tab in the first retracted position, the tab is prevented from moving out of the first retracted position without any external force being exerted on any component of the restrictor, the tab extending from the housing in the first restricting position, the tab is a one-piece unitary structure, so that the tab is rigid and all points in the tab move in unison without any other pieces moving, an entirety of the housing is to a first side of the first plane, at least a portion of the tab is in the housing in the first retracted position, the restrictor is positioned relative to the second member such that:

with the tab in the first restricting position, the tab prevents the second member from being moved through a movement sequence from a first position to a second position, the second surface of the second member moving in a first direction in the first plane during an entirety of said movement sequence, an entirety of the second member, except for the second surface, to a second side of the first plane, with the tab in the first retracted position, the tab does not prevent the second member from being moved relative to the first member through said movement sequence from the first position to the second position, and with the tab in the first retracted position, moving the second member from the first position to the second position in said movement sequence, causes contact between the second member and the tab during at least part of said movement sequence, and said contact between the second member and the tab causes the tab to move relative to the housing.

12. A sliding system as recited in claim 11, wherein all points in the tab pivotally move in unison without any other pieces moving.

13. A sliding system as recited in claim 11, wherein all points in the tab move translationally in unison without any other pieces moving.

14. A sliding system as recited in claim 11, wherein for each pair of points on the tab, a distance between the points remains constant and cannot change.

15. A restrictor, comprising:

a housing; and a tab, the tab is movable relative to the housing among at least a first tab position, a second tab position and a third tab position, the restrictor configured such that the tab is prevented from moving out of the second tab position without any external force being exerted on any component of the restrictor, an entirety of the tab is a one-piece unitary structure so that the tab is rigid and all points in the tab move in unison without any other pieces moving, the restrictor is configured such that the restrictor can be positioned relative to a window sash structure that has a flat front surface and a flat top surface, the flat top surface perpendicular to the flat front surface, such that:

an entirety of the window sash structure, other than the flat front surface, is to a first side of a first plane, and an entirety of the housing is to a second side of the first plane, with the tab in the first tab position, a first portion of the tab is to the first side of the first plane, the first portion of the tab comprises a first extremity of the tab, the first extremity of the tab spaced from the first plane by a first distance, the first distance is equal to or greater than respective distances that every other point on the tab is spaced from the first plane, with the tab in the second tab position, the first extremity of the tab is a second distance from the first plane, the second distance is smaller than the first distance, with the tab in the first tab position:

a second portion of the tab is to the second side of the first plane, the first portion of the tab and the second portion of the tab together comprising the entirety of the tab, the first side of the first plane and the second side of the first plane on respective opposite sides of the first plane, and the first portion of the tab would prevent the window sash structure, from being moved through a movement sequence, with the flat front surface moving in the first plane in a first direction during an entirety of said movement sequence, the first direction perpendicular to a second plane which is defined by said flat top surface, such that the window sash structure moves during said movement sequence (i) toward where the window sash structure comes into contact with the tab, (ii) then into contact with the tab, and then (iii) beyond where the window sash structure first contacts the tab, with the tab in the second tab position:

a third portion of the tab is to the first side of the first plane, and a fourth portion of the tab is to the second side of the first plane, the third portion of the tab and the fourth portion of the tab together comprising the entirety of the tab, the tab would not prevent moving said window sash structure through said movement sequence, and said window sash structure can be moved through said movement sequence, with the tab in the third tab position, the entirety of the tab is to the second side of the first plane.

16. A restrictor as recited in claim 15, wherein:

the third portion of the tab comprises a tapered surface, and with the tab in the second tab position, moving said window sash structure through said movement sequence would cause contact between the window sash structure and the tapered surface during at least part of said movement sequence, and said contact between the window sash structure and the tapered surface would cause the tab to move to the third tab position.

17. A restrictor as recited in claim 16, wherein with the tab in the second tab position, a surface of the tab is non-parallel with the first plane and non-perpendicular relative to the first plane.

18. A restrictor as recited in claim 15, wherein:

the restrictor comprises a pushing element, and moving said window sash structure through said movement sequence would also (1) cause the tab to move from the second tab position to the third tab position, and (2) cause the tab to come into contact along a first region of the flat front surface whereby the contact between the tab and the first region of the flat front surface would prevent the tab from being moved toward the first tab position by a force exerted by the pushing element.

19. A restrictor as recited in claim 18, wherein with the tab in the third tab position, by moving said window sash structure in a reverse movement such that the flat front surface moves along the first plane in a second direction during an entirety of said reverse movement, the second direction opposite the first direction, such that the flat front surface reaches a position at which no portion of the flat front surface blocks the tab from being moved from the third tab position to the first tab position by the force exerted by the pushing element, the tab would be held in the third tab position by the window sash structure until the flat front surface reaches said position at which no portion of the flat front surface blocks the tab from being moved from the third tab position to the first tab position, and upon the flat front surface reaching said position at which no portion of the flat front surface blocks the tab from being moved from the third tab position to the first tab position, the pushing element would push the tab from the third tab position to the first tab position.

20. A restrictor as recited in claim 15, wherein all points in the tab pivotally move in unison without any other pieces moving.

21. A restrictor as recited in claim 15, wherein all points in the tab move translationally in unison without any other pieces moving.

22. A restrictor as recited in claim 15, wherein for each pair of points on the tab, a distance between the points remains constant and cannot change.

23. A restrictor, comprising:

a housing;

a tab; and a pushing element, an entirety of the housing to a second side of a first plane, the tab movable relative to the housing among at least a first tab position, a second tab position and a third tab position, the restrictor configured such that with the tab in the first tab position, the tab is prevented from moving out of the first tab position without any external force being exerted on any component of the restrictor, the restrictor configured such that with the tab in the second tab position, the tab is prevented from moving out of the second tab position without any external force being exerted on any component of the restrictor, with the tab in the first tab position, a first portion of the tab is to a first side of the first plane, the first portion of the tab comprises a first extremity of the tab, the first extremity of the tab spaced from the first plane by a first distance, the first distance equal to or greater than respective distances that every other point on the tab is spaced from the first plane, with the tab in the second tab position, the first extremity of the tab is to the first side of the first plane, and the first extremity of the tab is a second distance from the first plane, the second distance is smaller than the first distance, with the tab in the third tab position, an entirety of the tab is to the second side of the first plane, upon pressing the tab to move the tab from the first tab position to the third tab position and then releasing the tab without applying any external force to any component of the restrictor, the pushing element pushes the tab to the second tab position, and upon pressing the tab to move the tab from the second tab position to the third tab position and then releasing the tab without applying any external force to any component of the restrictor, the pushing element pushes the tab to the first tab position.

24. A restrictor as recited in claim 23, wherein:

the tab comprises a tapered surface, and the restrictor is configured such that the restrictor can be positioned relative to a window sash structure that has a flat front surface and a flat top surface, the flat top surface perpendicular to the flat front surface such that:

an entirety of the window sash structure, other than the flat front surface, is to a first side of a first plane, and with the tab in the second tab position, moving the window sash structure through a movement sequence in which the flat front surface moves along the first plane in a first direction during an entirety of said movement sequence, the first direction perpendicular to a plane defined by said flat top surface, such that during the movement sequence, (i) the window sash structure comes into contact with the tapered surface and then (ii) the flat top surface moves past the tab, would cause (a) the tab to move from the second tab position to the third tab position, and (b) the window sash structure to block the tab from being pushed by the pushing element toward the first tab position during at least part of said movement sequence, and then moving said window sash structure through a reverse movement such that the flat front surface moves along the first plane in a second direction during an entirety of said reverse movement, the second direction is opposite the first direction, such that said flat top surface moves past the tab in the second direction, so that the flat front surface reaches a position at which no portion of the flat front surface blocks the tab from being moved by a force exerted by the pushing element, would result in the window sash structure no longer blocking the tab from being pushed by the pushing element from the third tab position toward the first tab position.

25. A restrictor as recited in claim 23, wherein:

the restrictor is configured such that the restrictor can be positioned relative to a window sash structure that has a flat front surface and a flat top surface that is perpendicular to the flat front surface such that:

an entirety of the window sash structure, other than the flat front surface, is to a first side of a first plane, and with the tab in the first tab position, the first portion of the tab would prevent the window sash structure, from being moved through a movement sequence, with the flat front surface moving along the first plane in a first direction during an entirety of said movement sequence, the first direction perpendicular to a plane defined by said flat top surface, beyond where the window sash structure first contacts the tab.

26. A restrictor as recited in claim 23, wherein:

the first portion of the tab and the second portion of the tab together comprise the entirety of the tab, the tab is a one-piece unitary structure so that the tab is rigid and all points in the tab move in unison without any other pieces moving, and with the tab in the second tab position, a third portion of the tab is to the first side of the first plane, a fourth portion of the tab is to the second side of the first plane, and the third and fourth portions of the tab together comprise the entirety of the tab.

27. A restrictor as recited in claim 23, wherein with the tab in the second tab position, a surface of the tab is non-parallel with the first plane and non-perpendicular relative to the first plane.

28. A sliding system, comprising:

at least a first member and a second member; and a restrictor, the second member having a first surface substantially aligned in a first plane, the first member having a second surface substantially aligned in a second plane, the second plane substantially parallel to the first plane, the restrictor comprising a housing and a tab, an entirety of the tab is a one-piece unitary structure, so that the tab is rigid and all points in the tab move in unison without any other pieces moving, an entirety of the housing is to a second side of the first plane, the tab movable relative to the housing among at least a first tab position, a second tab position and a third tab position, the restrictor configured such that the tab is prevented from moving out of the first tab position without any external force being exerted on any component of the restrictor, and the tab is prevented from moving out of the second tab position without any external force being exerted on any component of the restrictor, in the first tab position, a first portion of the tab is to a first side of the first plane, the first portion of the tab comprises a first extremity of the tab, the first extremity of the tab spaced from the first plane by a first distance, the first distance equal to or greater than respective distances that every other point on the tab is spaced from the first plane, in the second tab position, the first extremity of the tab is a second distance from the first plane, the second distance smaller than the first distance, with the tab in the first tab position:

a second portion of the tab is to the second side of the first plane, the first portion of the tab and the second portion of the tab together comprising the entirety of the tab, the first side of the first plane and the second side of the first plane on opposite sides of the first plane, and the first portion of the tab prevents the second member from being moved from a first closed position to a first open position, with the tab in the second tab position:

a third portion of the tab is to the first side of the first plane, and a fourth portion of the tab is to the second side of the first plane, the third portion of the tab and the fourth portion of the tab together comprising the entirety of the tab, and the third portion of the tab does not prevent the second member from being moved from the first closed position to the first open position, in the third tab position, the entirety of the tab is to the second side of the first plane, with the tab in the second tab position, moving the second member through a movement sequence, the first surface moving in the first plane in a first direction during an entirety of said movement sequence, from the first closed position to the first open position, causes contact between the second member and the tab during at least part of said movement sequence.

29. A sliding system as recited in claim 28, wherein the third portion of the tab comprises a tapered surface, and said contact between the window sash structure and the tapered surface would cause the tab to move to the third tab position.

30. A sliding system as recited in claim 29, wherein with the tab in the second tab position, a surface of the tab is non-parallel with the first plane and non-perpendicular relative to the first plane.

31. A sliding system as recited in claim 28, wherein:

the restrictor further comprises a pushing element, and said movement sequence also (1) causes the tab to move from the second tab position to the third tab position, and (2) causes contact between the tab and the first surface along a first region of the first surface, and the contact between the tab and the first surface along the first part of the first surface prevents the tab from being moved toward the first tab position by a force exerted by the pushing element.

32. A sliding system as recited in claim 31, wherein with the tab in the third tab position, by moving the second member from the first open position to the first closed position, the second member reaches a position at which no portion of the first surface blocks the tab from being moved by the force exerted by the pushing element, whereby the force exerted by the pushing element moves the tab from the third tab position to the first tab position.

33. A sliding system as recited in claim 28, wherein the first member is a first sash member and the second member is a second sash member.

34. A sliding system as recited in claim 28, wherein all points in the tab pivotally move in unison without any other pieces moving.

35. A sliding system as recited in claim 28, wherein all points in the tab move translationally in unison without any other pieces moving.

36. A sliding system as recited in claim 28, wherein for each pair of points on the tab, a distance between the points remains constant and cannot change.

37. A sliding system, comprising:

at least a first member and a second member; and a restrictor, the second member having a first surface substantially aligned in a first plane, the first member having a second surface substantially aligned in a second plane, the second plane substantially parallel to the first plane, the restrictor comprising a housing, a tab and a pushing element, an entirety of the housing to a second side of the first plane, the tab movable relative to the housing among at least a first tab position, a second tab position and a third tab position, the restrictor configured such that with the tab in the first tab position, the tab is prevented from moving out of the first tab position without any external force being exerted on any component of the restrictor, the restrictor configured such that with the tab in the second tab position, the tab is prevented from moving out of the second tab position without any external force being exerted on any component of the restrictor, with the tab in the first tab position, a first portion of the tab is to a first side of the first plane, the first portion of the tab comprises a first extremity of the tab, the first extremity of the tab spaced from the first plane by a first distance, the first distance equal to or greater than respective distances that every other point on the tab is spaced from the first plane, with the tab in the second tab position, the first extremity of the tab is to the first side of the first plane, and is a second distance from the first plane, the second distance smaller than the first distance, with the tab in the third tab position, an entirety of the tab is to the second side of the first plane, upon pressing the tab to move the tab from the first tab position to the third tab position and then releasing the tab without applying any external force to any component of the restrictor, the pushing element pushes the tab to the second tab position, and upon pressing the tab to move the tab from the second tab position to the third tab position and then releasing the tab without applying any external force to any component of the restrictor, the pushing element pushes the tab to the first tab position.

38. A sliding system as recited in claim 37, wherein:

the tab comprises a tapered surface, and with the tab in the second tab position, moving the second member through a movement sequence in which the first surface moves along the first plane in a first direction during an entirety of said movement sequences, from a first closed position to a first open position, (a) causes the tab to move from the second tab position to the third tab position, and (b) causes the second member to prevent the tab from being pushed by the pushing element toward the first tab position during at least part of the movement sequence, and then moving the second member from the first open position to the first closed position results in the second member moving to a position where the second member no longer prevents the tab from being pushed by the pushing element toward the first tab position, such that the force exerted by the pushing element moves the tab from the third tab position to the first tab position.

39. A sliding system as recited in claim 37, wherein with the tab in the first tab position:

the first portion of the tab is to a first side of the first plane, and a second portion of the tab is to the second side of the first plane, the first portion of the tab and the second portion of the tab together comprising the entirety of the tab, the first side of the first plane and the second side of the first plane on opposite sides of the first plane, and the first portion of the tab prevents the second member from being moved from a first closed position to a first open position.

40. A sliding system as recited in claim 37, wherein the first member is a first sash member and the second member is a second sash member.

41. A sliding system, comprising:

at least a first member and a second member; and a restrictor, the second member having a first surface substantially aligned in a first plane, the first member having a second surface substantially aligned in a second plane, the second plane substantially parallel to the first plane, the restrictor comprising a housing and a tab, the tab movable relative to the housing between at least a first tab position and a second tab position, the restrictor configured such that the tab is prevented from moving out of the second tab position without any external force being exerted on any component of the restrictor, the tab is a one-piece unitary structure, so that the tab is rigid and all points in the tab move in unison without any other pieces moving, an entirety of the housing to a second side of the first plane, with the tab in the first tab position:

a first portion of the tab is to a first side of the first plane, and a second portion of the tab is to the second side of the first plane, the first portion of the tab and the second portion of the tab together comprising an entirety of the tab, the first side of the first plane and the second side of the first plane on opposite sides of the first plane, and the first portion of the tab prevents the second member from being moved through a movement sequence, the first surface moving in the first plane in a first direction during an entirety of said movement sequence, from a first closed position to a first open position, with the tab in the second tab position, the tab does not prevent the second member from being moved in said movement sequence from the first closed position to the first open position, and by moving the second member through the movement sequence, the second member contacts the tab during at least part of said movement sequence.

42. A sliding system as recited in claim 41, wherein the first member is a first sash member and the second member is a second sash member.

43. A sliding system as recited in claim 41, wherein all points in the tab pivotally move in unison without any other pieces moving.

44. A sliding system as recited in claim 41, wherein all points in the tab move translationally in unison without any other pieces moving.

45. A sliding system as recited in claim 41, wherein for each pair of points on the tab, a distance between the points remains constant and cannot change.

46. A restrictor for restricting the movement of a sash between a first range of sash positions and a second range of sash positions, the restrictor comprising:

a housing;

a tab; and a pushing element, wherein:

an entirety of the tab is a one-piece unitary structure so that the tab is rigid and all points in the tab move in unison without any other pieces moving, the tab is moveable with respect to the housing between at least a first tab position relative to the housing and a second tab position relative to the housing, the first tab position relative to the housing differing from the second tab position relative to the housing, the restrictor can be attached to a sash system in which:

the sash system comprises said sash and a first structure, the sash comprises at least a first surface and a second surface, the first surface is substantially aligned in a first plane, the second surface is substantially aligned in a second plane, the second plane is substantially perpendicular to the first plane, the sash is movable relative to the first structure in a first direction perpendicular to said second plane in a range between a first extreme position and a second extreme position, said sash is prevented from moving to any position relative to the first structure outside of said range between said first extreme position and said second extreme position, said first range of sash positions and said second range of sash positions within said range between said first extreme position and said second extreme position, said first extreme position at an end of said first range of sash positions most remote from the second range of sash positions, said second extreme position at an end of said second range of sash positions most remote from said first range of sash positions, each of said second range of sash positions spaced from each of said first range of sash positions, in such a way that:

with the tab in the first tab position relative to the housing, movement of the sash within said first range of sash positions such that the second surface moves in said first direction brings the second surface into contact with the tab, and said contact prevents the second surface from moving past the tab into said second range of positions, with the tab in the first tab position relative to the housing, the tab can be manually moved from the first tab position relative to the housing to the second tab position relative to the housing, with the tab in the second tab position relative to the housing, and the sash in any position in the first range of sash positions, the sash can be moved such that the second surface moves in the first direction, such that the sash comes into contact with the tab and then is moved beyond the first range of sash positions into the second range of sash positions, with the sash in any position in the second range of sash positions, the pushing element urges the tab so that the tab presses against the sash, moving the sash in a second direction, said second direction opposite said first direction, from a position in the second range of sash positions to a position in the first range of sash positions moves the sash out of a range of positions where the tab presses against the sash, so that the pushing element is not prevented by the sash from pushing the tab from the second tab position relative to the housing to the first tab position relative to the housing, and said tab presses against the sash for an entirety of moving the sash in the second direction from the second extreme position through the second range of sash positions.

47. A restrictor as recited in claim 46, wherein the tab is pivotally attached to the housing.

48. A restrictor as recited in claim 46, wherein the first structure is a second sash.

49. A restrictor as recited in claim 46, wherein the sash is a window sash.

50. A restrictor for restricting the movement of a sash between a first sash position and a second range of sash positions, the restrictor comprising:

a housing;

a tab; and a pushing element, wherein:

an entirety of the tab is a one-piece unitary structure, so that the tab is rigid and all points in the tab move in unison without any other pieces moving, the tab is moveable with respect to the housing between at least a first tab position relative to the housing and a second tab position relative to the housing, the first tab position relative to the housing differing from the second tab position relative to the housing, the restrictor can be attached to a sash system in which:

the sash system comprises said sash and a first structure, the sash comprises at least a first surface and a second surface, the first surface is substantially aligned in a first plane, the second surface is substantially aligned in a second plane, the second plane is substantially perpendicular to the first plane, the sash is movable relative to the first structure in a first direction perpendicular to said second plane in a range between a first extreme position and a second extreme position, said sash is prevented from moving to any position relative to the first structure outside of said range between said first extreme position and said second extreme position, said second extreme position at an end of said range of sash positions most remote from said first extreme position, said range of sash positions comprising a first sub-range of positions and a second sub-range of positions, the first sub-range of positions extending from the first extreme position to a tab-limited sash position, the second sub-range of positions extending from the tab-limited sash position to the second extreme position, in such a way that:

with the tab in the first tab position relative to the housing and the sash in the first extreme position, the sash can be moved in the first direction until the sash reaches the tab-limited sash position, where the second surface comes into contact with an edge of the tab, and said contact prevents the sash from continuing to move in said first direction past the tab into said second sub-range of positions, with the tab in the first tab position relative to the housing, the tab can be manually moved from the first tab position relative to the housing to the second tab position relative to the housing, with the tab in the second tab position relative to the housing and the sash in the first extreme position, the sash can be moved in the first direction such that the sash reaches the tab-limited sash position where the second surface comes into contact with the tab, and the sash can be further moved in the first direction beyond the tab-limited sash position into the second sub-range of sash positions, with the sash in any position in the second sub-range of sash positions, the pushing element urges the tab so that the tab presses against the sash and the sash prevents the tab from moving to the first tab position, moving the sash in a second direction, said second direction opposite said first direction, from a position in the second sub-range of sash positions to any position in the first sub-range of sash positions results in the sash not preventing the tab from moving to the first tab position, so that the pushing element pushes the tab to the first tab position relative to the housing, and said tab presses against the sash for an entirety of the sash being in the second range of sash positions.

51. A restrictor as recited in claim 50, wherein the tab is pivotally attached to the housing.

52. A restrictor as recited in claim 50, wherein the first structure is a second sash.

53. A restrictor as recited in claim 50, wherein the sash is a window sash.

54. A sliding system comprising:

a first structure;

a sash; and a restrictor, the sash comprising at least a first surface and a second surface, the first surface substantially aligned in a first plane, the second surface substantially aligned in a second plane, the second plane substantially perpendicular to the first plane, the sash movable relative to the first structure in a first direction perpendicular to said second plane in a range between a first extreme position and a second extreme position, said sash is prevented from moving to any position relative to the first structure outside of said range between said first extreme position and said second extreme position, said second extreme position at an end of said range most remote from said first extreme position, the restrictor comprising:

a housing;

a tab; and a pushing element, wherein:

an entirety of the tab is a one-piece unitary structure, so that the tab is rigid and all points in the tab move in unison without any other pieces moving, the tab is moveable with respect to the housing from at least a first tab position relative to the housing to a second tab position relative to the housing, the first tab position relative to the housing differing from the second tab position relative to the housing, the restrictor is attached to the first structure, with the tab in the first tab position relative to the housing, the tab prevents the sash from being moved in the first direction beyond a first sash position, with the tab in the first tab position relative to the housing, the tab can be manually moved from the first tab position relative to the housing to the second tab position relative to the housing, with the tab in the second tab position relative to the housing, the sash can be moved in the first direction beyond the first sash position into a first sub-range of sash positions, with the sash in any position in the first sub-range of sash positions, the pushing element urges the tab so that the tab presses against the sash, moving the sash in a second direction, said second direction opposite said first direction, from a position in the first sub-range of sash positions to the first sash position results in the sash not preventing the tab from moving to the first tab position, so that the pushing element pushes the tab to the first tab position relative to the housing, and said tab presses against the sash for an entirety of the sash being in the first sub-range of sash positions.

55. A sliding system as recited in claim 54, wherein the tab is pivotally attached to the housing.

56. A sliding system as recited in claim 54, wherein the first structure is a second sash.

57. A sliding system as recited in claim 54, wherein the sash is a window sash.

58. A sliding system as recited in claim 54, wherein the housing is mounted in a first side frame member of the first structure.

59. A sliding system as recited in claim 54, wherein:

the first surface of the sash has a first surface first edge and a first surface second edge, a third plane defined by the first surface first edge and a fourth plane defined by the first surface second edge are substantially perpendicular to the first direction and are spaced from each other in the first direction, the first surface first edge and the first surface second edge comprise opposite edges of the sash, and the first side frame member extends from the first edge to the second edge.

60. A sliding system as recited in claim 59, wherein:

said restrictor is a first restrictor and the sliding system further comprises a second restrictor, the second restrictor comprises:

a second housing;

a second tab; and a second pushing element, wherein:

the second tab is moveable with respect to the second housing between at least a second tab first position relative to the second housing and a second tab second position relative to the second housing, the second restrictor is attached to the first structure, with the second tab in the second tab first position relative to the second housing, the sash can be moved in the first direction from the first sash position to a position in which there is contact between the second surface of the sash and the second tab, and said contact between the second surface of the sash and the second tab prevents the sash from being moved in the first direction such that the second surface of the sash moves beyond the second tab and the sash moves into said second range of positions, with the second tab in the second tab first position relative to the second housing, the second tab can be manually moved from the second tab first position relative to the second housing to the second tab second position relative to the second housing.

61. A sliding system as recited in claim 60, wherein:

upon moving the sash in the first direction from the first sash position toward the second extreme position, the sash contacts the tab of the first restrictor after moving the sash in the first direction a first distance, and the sash contacts the second tab after moving the sash in the first direction a distance approximately equal to the first distance.

62. A sliding system, comprising:

at least a first member and a second member; and a restrictor, the second member having a first surface substantially aligned in a first plane, the first member having a second surface substantially aligned in a second plane, the second plane substantially parallel to the first plane, the restrictor comprising a housing, a tab and a pushing element, an entirety of the housing to a second side of the first plane, the tab is movable relative to the housing among at least a first tab position, a second tab position and a third tab position, the restrictor configured such that with the tab in the first tab position, the tab is prevented from moving out of the first tab position without any external force being exerted on any component of the restrictor, the restrictor configured such that with the tab in the second tab position, the tab is prevented from moving out of the second tab position without any external force being exerted on any component of the restrictor, with the tab in the first tab position, a first portion of the tab is to a first side of the first plane, the first portion of the tab comprises a first extremity of the tab, the first extremity of the tab spaced from the first plane by a first distance, the first distance equal to or greater than respective distances that every other point on the tab is spaced from the first plane, with the tab in the second tab position, a second portion of the tab is to the first side of the first plane, the first extremity of the tab is to the first side of the first plane, and the first extremity of the tab is a second distance from the first plane, the second distance smaller than the first distance, with the tab in the third tab position, an entirety of the tab is to the second side of the first plane, upon pressing the tab to move the tab from the first tab position to the third tab position and then releasing the tab without applying any external force to any component of the restrictor, the pushing element pushes the tab to the second tab position, the second member movable relative to the first member in a first direction in the first plane in a range from a first position to a second position, the second member is prevented from moving to any position relative to the first member outside of said range between said first position and said second position, and with the tab in the second tab position, moving the second member through a movement sequence, the first surface moving in the first plane in the first direction during an entirety of said movement sequence, causes the second member to press the tab to move the tab from the second tab position to the third tab position.

63. A sliding system comprising:

a first member;

a second member, the second member comprising a first surface and a second surface, the first surface defining a second plane, the second surface defining a first plane, the second plane substantially perpendicular to the first plane, the second member movable in a first direction whereby the first surface moves in the first plane in the first direction, the second member movable in a second direction whereby the first surface moves in the first plane in the second direction, the second direction opposite to the first direction; and a restrictor, the restrictor comprising:

a housing; and a tab, the tab moveable relative to the housing between at least a first restricting position and at least a first retracted position, the restrictor configured such that with the tab in the first restricting position, the tab is prevented from moving out of the first restricting position without any external force being exerted on any component of the restrictor, the restrictor configured such that with the tab in the first retracted position, the tab is prevented from moving out of the first retracted position without any external force being exerted on any component of the restrictor, the tab extending from the housing in the first restricting position, the tab is a one-piece unitary structure, so that the tab is rigid and all points in the tab move in unison without any other pieces moving, at least a portion of the tab in the housing in the first retracted position, the restrictor positioned relative to the second member such that:

with the tab in the first restricting position, moving the second member in a first movement sequence in which the second member moves in the first direction during an entirety of said first movement sequence causes contact between the second member and the tab at only an end of said first movement sequence, with the tab in the first retracted position, moving the second member in a second movement sequence in which the second member moves in the first direction during an entirety of said second movement sequence causes contact between the second member and the tab during at least part of said second movement sequence.

64. A sliding system as recited in claim 63, wherein all points in the tab pivotally move in unison without any other pieces moving.

65. A sliding system as recited in claim 63, wherein all points in the tab move translationally in unison without any other pieces moving.

66. A sliding system as recited in claim 63, wherein for each pair of points on the tab, a distance between the points remains constant and cannot change.

* * * * *